US006478937B2

(12) United States Patent
Olgado et al.

(10) Patent No.: US 6,478,937 B2
(45) Date of Patent: Nov. 12, 2002

(54) SUBSTRATE HOLDER SYSTEM WITH SUBSTRATE EXTENSION APPARATUS AND ASSOCIATED METHOD

(75) Inventors: Donald J. K. Olgado, Palo Alto, CA (US); Jayant Lakshmikanthan, Sunnyvale, CA (US)

(73) Assignee: Applied Material, Inc., Santa Clara, CA (US)

( * ) Notice: Subject to any disclaimer, the term of this patent is extended or adjusted under 35 U.S.C. 154(b) by 86 days.

(21) Appl. No.: 09/765,855

(22) Filed: Jan. 19, 2001

(65) Prior Publication Data

US 2002/0096436 A1 Jul. 25, 2002

(51) Int. Cl.[7] ..... B23H 7/26

(52) U.S. Cl. ..... 204/297.03; 204/297.09; 204/297.1; 204/297.14; 204/199; 204/212; 204/213; 204/287; 204/288.3

(58) Field of Search ..... 204/297.03, 297.08, 204/297.09, 297.1, 297.14, 287, 288.3, 199, 212, 213

(56) References Cited

U.S. PATENT DOCUMENTS

| | | | |
|---|---|---|---|
| 2,742,413 A | 4/1956 | Cransberg et al. | 204/52 |
| 2,882,209 A | 4/1959 | Brown et al. | 204/52 |
| 3,649,509 A | 3/1972 | Morawetz et al. | 204/238 |

(List continued on next page.)

FOREIGN PATENT DOCUMENTS

| | | |
|---|---|---|
| DE | 932 709 | 3/1955 |
| JP | 58-82823 | 10/1983 |
| JP | 63-18093 | 5/1988 |
| JP | 04-131395 | 5/1992 |
| JP | 04-80993 | 10/1992 |
| JP | 06-17291 | 1/1994 |
| SU | 443 108 A | 9/1974 |
| WO | 97/12079 | 4/1997 |
| WO | 99/25902 | 5/1999 |
| WO | 99/25903 | 5/1999 |
| WO | 99/25904 | 5/1999 |
| WO | 99/25905 | 5/1999 |
| WO | 99/26275 | 5/1999 |

OTHER PUBLICATIONS

"Wafer Back Surface Film Removal", Colombo, L., Central R&D, SGS–Thomson Microelectronics, Agrate, Italy, 6 pages.

"Metallization & Interconnect", SEMITOOL Products/Sales, Oct. 27, 1998, 4 pages.

Laurell Technologies Corporation, Oct. 27, 1998, 6 pages.

"VERTEQ" VERTEQ Online, 5 pages.

"Tantalum, Copper and Damascene: The Future of Interconnects", Singer, P., Semiconductor International, Jun. 1998, 6 pages.

(List continued on next page.)

*Primary Examiner*—Bruce F. Bell

(74) *Attorney, Agent, or Firm*—Moser, Patterson, Sheridan LLP.

(57) ABSTRACT

An apparatus and associated method that removes electrolyte solution from a substrate, the apparatus comprises a thrust plate and a substrate extension unit. The thrust plate at least partially defines a spin recess. The substrate extension unit can be displaced between a retracted position and an extended position relative to the spin recess. The substrate extension unit is disposed within the spin recess when positioned in the retracted position. The substrate extension unit at least partially extends from within the spin recess when positioned in the extended position. The substrate is processed by immersing at least a portion of the substrate in a wet solution. The substrate is removed from the wet solution. The substrate extension unit extends into its extended position, and the substrate is spun. Extending the substrate extension unit limits the formation of fluid traps within the substrate holder assembly or between the substrate and the substrate holder assembly.

28 Claims, 14 Drawing Sheets

U.S. PATENT DOCUMENTS

| | | | | |
|---|---|---|---|---|
| 3,727,620 | A | 4/1973 | Orr | 134/95 |
| 3,770,598 | A | 11/1973 | Creutz | 204/52 R |
| 4,027,686 | A | 6/1977 | Shortes et al. | 134/95 |
| 4,092,176 | A | 5/1978 | Kozai et al. | 134/186 |
| 4,110,176 | A | 8/1978 | Creutz | 204/52 R |
| 4,113,492 | A | 9/1978 | Sato et al. | 96/67 |
| 4,315,059 | A | 2/1982 | Raistrick et al. | 429/112 |
| 4,326,940 | A | 4/1982 | Eckles et al. | 204/232 |
| 4,336,114 | A | 6/1982 | Mayer et al. | 204/52 R |
| 4,376,685 | A | 3/1983 | Watson | 204/52 R |
| 4,405,416 | A | 9/1983 | Raistrick et al. | 204/68 |
| 4,428,815 | A | 1/1984 | Powell et al. | 204/297 |
| 4,435,266 | A | 3/1984 | Johnston | 204/276 |
| 4,489,740 | A | 12/1984 | Rattan et al. | 134/140 |
| 4,510,176 | A | 4/1985 | Cuthbert et al. | 427/82 |
| 4,518,678 | A | 5/1985 | Allen | 430/311 |
| 4,519,846 | A | 5/1985 | Aigo | 134/15 |
| 4,693,805 | A | 9/1987 | Quazi | 204/192.22 |
| 4,732,785 | A | 3/1988 | Brewer | 427/240 |
| 4,789,445 | A | 12/1988 | Goffman et al. | 204/114 |
| 5,039,381 | A | 8/1991 | Mullarkey | 204/47.5 |
| 5,055,425 | A | 10/1991 | Leibovitz et al. | 437/195 |
| 5,092,975 | A | 3/1992 | Yamamura et al. | 204/198 |
| 5,155,336 | A | 10/1992 | Gronet et al. | 219/411 |
| 5,162,260 | A | 11/1992 | Leibovitz et al. | 437/195 |
| 5,222,310 | A | 6/1993 | Thompson et al. | 34/202 |
| 5,224,504 | A | 7/1993 | Thompson et al. | 134/155 |
| 5,230,743 | A | 7/1993 | Thompson et al. | 134/32 |
| 5,252,807 | A | 10/1993 | Chizinsky | 219/390 |
| 5,256,274 | A | 10/1993 | Poris | 205/123 |
| 5,259,407 | A | 11/1993 | Tuchida et al. | 134/151 |
| 5,290,361 | A | 3/1994 | Hayashida et al. | 134/2 |
| 5,316,974 | A | 5/1994 | Crank | 437/190 |
| 5,328,589 | A | 7/1994 | Martin | 205/296 |
| 5,349,978 | A | 9/1994 | Sago et al. | 134/153 |
| 5,368,711 | A | 11/1994 | Poris | 204/193 |
| 5,377,708 | A | 1/1995 | Bergman et al. | 134/105 |
| 5,415,890 | A | 5/1995 | Kloiber et al. | 427/242 |
| 5,429,733 | A | 7/1995 | Ishida | 204/224 R |
| 5,447,615 | A | 9/1995 | Ishida | 204/224 R |
| 5,454,930 | A | 10/1995 | Miura et al. | 205/159 |
| 5,516,412 | A | 5/1996 | Andrlcacos et al. | 204/224 R |
| 5,528,118 | A | 6/1996 | Lee | 318/568.17 |
| 5,608,943 | A | 3/1997 | Konishi et al. | 15/302 |
| 5,625,170 | A | 4/1997 | Poris | 177/50 |
| 5,651,865 | A | 7/1997 | Sellers | 204/192.13 |
| 5,705,223 | A | 1/1998 | Bunkofske | 427/240 |
| 5,718,813 | A | 2/1998 | Drummond et al. | 204/192.12 |
| 5,723,028 | A | 3/1998 | Poris | 204/231 |
| 5,730,890 | A | 3/1998 | Bickford et al. | 216/87 |
| 5,838,121 | A | 11/1998 | Fairbairn et al. | 318/45 |
| 6,024,856 | A | 2/2000 | Haydu et al. | 205/84 |
| 6,071,388 | A | 6/2000 | Uzoh | 204/297 R |
| 6,093,291 | A | 7/2000 | Izumi et al. | 204/224 R |
| 6,113,771 | A | 9/2000 | Landau et al. | 205/123 |
| 6,258,220 | B1 * | 7/2001 | Dordi et al. | 204/198 |
| 6,267,853 | B1 * | 7/2001 | Dordi et al. | 204/297.08 |

OTHER PUBLICATIONS

"Wafer Processing", Singer, P., Semiconductor International, Jun. 1998, p. 70.

"Ney Contact Manual", Pitney, K., Electrical Contacts For Low Energy Uses, Oct. 8, 1974, 19 pages.

"Electric Contacts Theory and Application", Holm, R., Springer–Verlag New York Inc, 1967, 27 pages.

U.S. patent application Ser. No. 09/295,678, Landau, filed Apr. 21,1999.

U.S. patent application Ser. No. 09/263,649 Shen et al., filed Mar. 5, 1999.

U.S. patent application Ser. No. 09/484,616, Landau, et al., filed Jan 18, 2000.

U.S. patent application Ser. No. 09/658,336, Hey, et al., filed Sep. 8, 2000.

U.S. patent application Ser. No. 09/731,326, Dordi et al., filed Dec. 5, 2000.

U.S. patent application Ser. No. 09/663,814, Olgado, filed Sep. 15, 2000.

U.S. patent application No. 09/664,607, Olgado, filed Sep. 18, 2000.

U.S. patent application No. 09/676, 362, Olgado, filed Sep. 29, 2000.

U.S patent application No. 09/678,947, Dordi, et al., filed Oct. 3, 2000.

U.S. patent application No. 09/766,060, Hey et al., filed Jan. 18, 2001.

U.S. patent application No. 09/687,053, Hey, et al., filed OLct. 12, 2000.

U.S. patent application No. 09/684,500, Olgado, filed Oct. 6, 2000.

* cited by examiner 14
2410
66
2213
1240
2282
2283
2282
221
2209
15
2278
266
2283
2212
1214
2292
16
2289
2280
2290
2294
2294
222
CONTROLLER
CPU
1260
MEMORY
1262
I/O
1279
CIRCUITS
1265
2287
2212

SUBSTRATE HOLDER SYSTEM WITH SUBSTRATE EXTENSION APPARATUS AND ASSOCIATED METHOD

BACKGROUND OF THE INVENTION

1. Field of the Invention

The present invention generally relates to a substrate holder system used during deposition of a metal film on a substrate.

2. Background of the Related Art

Electroplating, previously limited in integrated circuit design to the fabrication of lines on circuit boards, is now used to form interconnect features such as vias, trenches, and electric contact elements on substrates. One feature-fill process that includes electroplating involves initially depositing a non-metallic diffusion barrier layer over the feature surfaces by a process such as physical vapor deposition (PVD), chemical vapor deposition (CVD), or electroless metal deposition. A metallic seed layer is then deposited on the diffusion barrier layer by a process such as PVD, CVD, or electroless metal deposition. A metal film is then deposited by electroplating on the seed layer. Finally, the deposited metal film can be planarized by another process such as chemical mechanical polishing (CMP).

Electroplating, as well as certain other metal deposition processes such as CMP and electroless plating, are wet processes. The electrolyte solution is a liquid that contains chemicals such as copper sulfate that is a source of copper for the plating process. The electrolyte solution used during electroplating can flow to undesirable locations on the substrate, a substrate holder system used to hold the substrate during electroplating, or other robotic or processing equipment. The copper sulfate in the electrolyte solution can dry on a surface of the substrate or processing equipment into crystals, after the substrate is removed from the electrolyte solution. The crystals can contaminate robots and processing equipment, e.g., the substrate holder system, that come into subsequent contact with the substrate or processing equipment. Metal deposits can also form at undesired locations on the substrate, such as on the edge and/or the backsides.

Electroplating cells, in which substrates are typically disposed within during electroplating, contain electrolyte solution. An anode and the seed layer on the substrate are both immersed in the electrolyte solution during plating. The substrate is supported by, e.g., electric contact elements such as a contact ring. Individual electric contact elements are laterally separated from each other around the periphery of a contact ring. Each electric contact element physically contacts a portion of the seed layer. However, it is difficult to provide an effective fluid seal around the individual electric contact elements between the substrate and the contact ring due to the irregular shape and the position of the electric contact element. Electrolyte solution can flow between the substrate, the substrate holder, and a plurality of spaced electric contacts to flow to the edge and the backside of the substrate. The electrolyte solution flowing to the edge and the backside of the substrates leads to possible deposit buildup at these locations that is generally referred to as backside plating.

Backside plating requires post-plating cleaning of the substrate to avoid contamination problems during subsequent processing. A common technique to remove the unwanted deposits involves the application of an etchant or removal agent to selected surfaces of the substrate in, e.g., spin-rinse-dry (SRD) and integrated bead clean (IBC) systems. The thicker the depth of the unwanted deposits, the longer duration is necessary to remove the unwanted deposits in the SRD or IBC systems. Excessive processing, e.g., cleaning and/or etching of the substrates, by present SRD and IBC systems can be expensive since the materials and chemicals used in such systems are often very expensive and the processing time reduces the throughput of substrates through electroplating systems. Minimizing the amount of backside deposition that forms on the substrates is thus desirable.

To limit the amount of undesired deposits and/or chemicals such as copper sulfate crystals that form on the substrate, the substrate is often spun, preferably from between about 0 RPM to about 3000 RPM, after the substrate is removed from the electrolyte solution within the electrolyte cell. The substrate is secured and displaced within a substrate holder assembly portion of the substrate holder system during the spinning operation. The spinning is intended to remove the electrolyte solution from the surfaces of the substrate and the surfaces of the substrate holder assembly that come in contact with the electrolyte solution. Unfortunately, certain surfaces of the substrate holder assembly and/or substrate form fluid traps. These fluid traps retain, and make it difficult to remove, residual electrolyte solution from the substrate and the substrate holder assembly during spinning. Eventually, the electrolyte chemicals, e.g., crystals, retained within the fluid traps build up on the surfaces of the substrate and/or the substrate holder assembly. Any substrates or processing equipment that subsequently come in contact with either the contaminated substrate or substrate holder assembly may, themselves, become contaminated by the residual electrolyte solution and copper sulfate crystals.

In addition, vacuum chucks often are used by robots to load/unload the substrates respectively in/from various cells. Vacuum chucks that are used in electroplating systems typically employ vacuum plates. However, the rigidity and planar configuration of both vacuum plates and substrates limit establishing a flush interface between the mating components if irregular deposits or built-up chemical crystals are present on a chucking surface of a substrate or the vacuum plate. Vacuum leaks often occur if a flush interface has not been established between the vacuum plate and the substrate.

Therefore, there remains a need for an improved method and apparatus that limits the unwanted deposits and chemical buildup on the substrate and the substrate holder assembly. This limiting of unwanted deposits could be accomplished by providing a substrate holder assembly configured to limit the formation of fluid traps after removal of the substrate from the electrolyte solution so that spinning of the substrate and substrate holder assembly results in more efficient removal of the residual electrolyte solution from the substrate and/or the substrate holder assembly.

SUMMARY OF THE INVENTION

The invention generally provides an apparatus and associated method that removes electrolyte solution from a substrate. The apparatus comprises a thrust plate formed from a main thrust plate portion and a substrate extension unit. The surfaces of the main thrust plate portion at least partially defines a spin recess. The substrate extension unit can be displaced between a retracted position and an extended position relative to the spin recess. The substrate extension unit is disposed within the spin recess when positioned in the retracted position. The substrate extension unit at least partially extends from within the spin recess when positioned in the extended position. The substrate is processed by immersing at least a portion of the substrate into a wet solution. Following removal of the substrate from the wet solution, the substrate extension unit is displaced into its extended position and the substrate is spun. Extending the substrate extension unit limits the formation of fluid traps within the substrate holder assembly or between the substrate and the substrate holder assembly.

BRIEF DESCRIPTION OF THE DRAWINGS

FIG. 7 including

To facilitate understanding, identical reference numerals have been used, where possible, to designate similar elements that are common to the figures.

DETAILED DESCRIPTION OF THE PREFERRED EMBODIMENT

This disclosure is directed generally to processing systems in which substrates are immersed in wet process cells that are utilized wet processes such as electro chemical plating (ECP). One example of a wet process cell is an electrolyte cell that is used in ECP.

Substrate holder systems 14 associated with ECP systems are used to immerse substrates into, or remove substrates from, electrolyte solution in the process cell. Certain substrate holder system embodiments rotate the substrate when the substrate is being immersed into, is contained within, or is being removed from, the electrolyte solution. To enhance the substrate drying action during spinning, the substrate and selected portions of a substrate holder assembly are each displaced to different vertical positions after the substrate is removed from the electrolyte solution to limit fluid traps being formed by adjacent component surfaces of either the substrate holder assembly and/or the substrate. Therefore, as the combined substrate and the substrate holder assembly are spun following their removal from the electrolyte solution, the electrolyte solution on the surfaces thereof will be laterally sprayed away from the substrate holder assembly and the substrate by the inertia imparted to the electrolyte solution as a result of the rotation.

1. ECP System

Figure 1A:
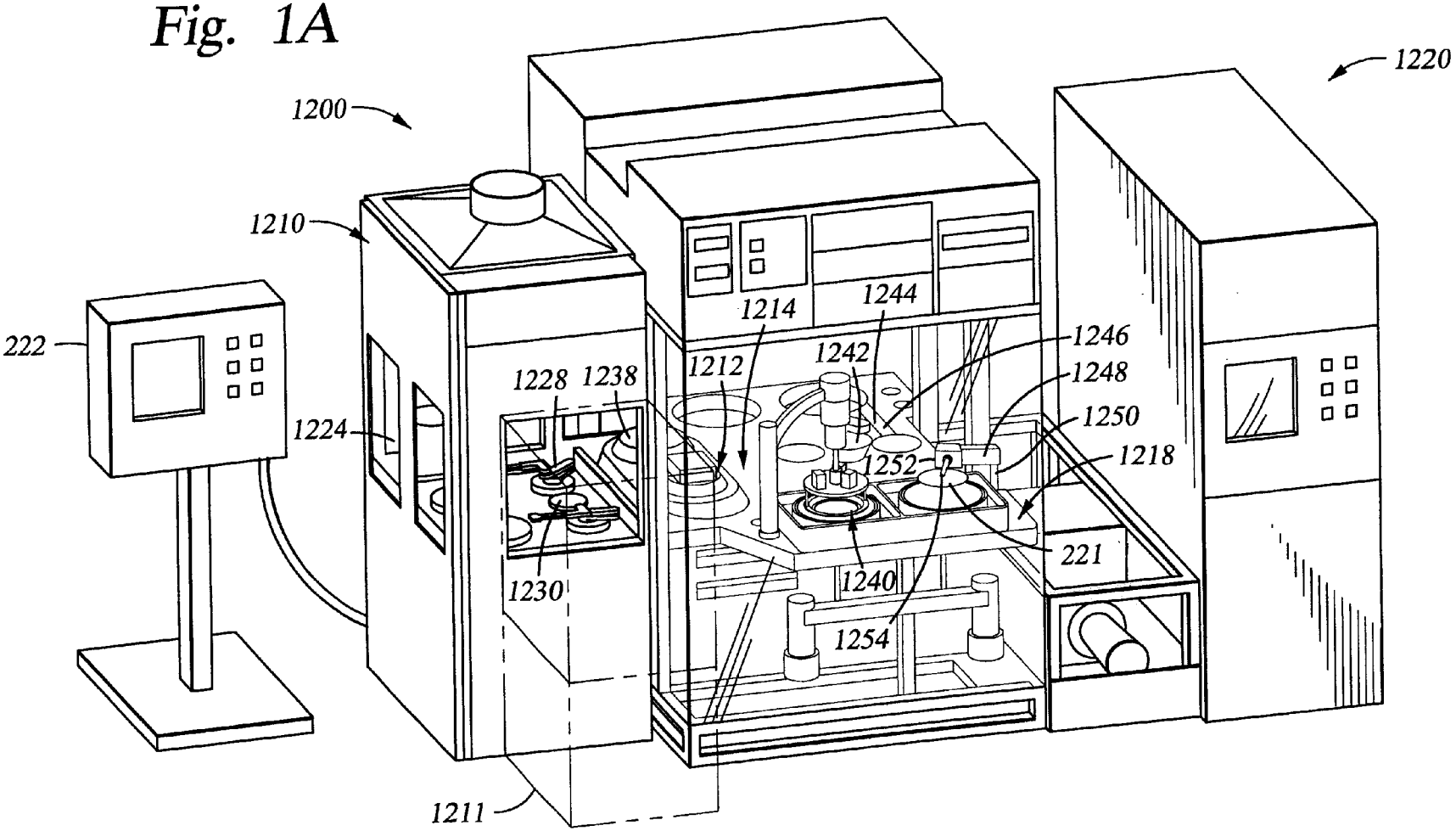
FIG. 1A is a perspective view of one embodiment of an electro-chemical plating (ECP) system.
Figure 1B:
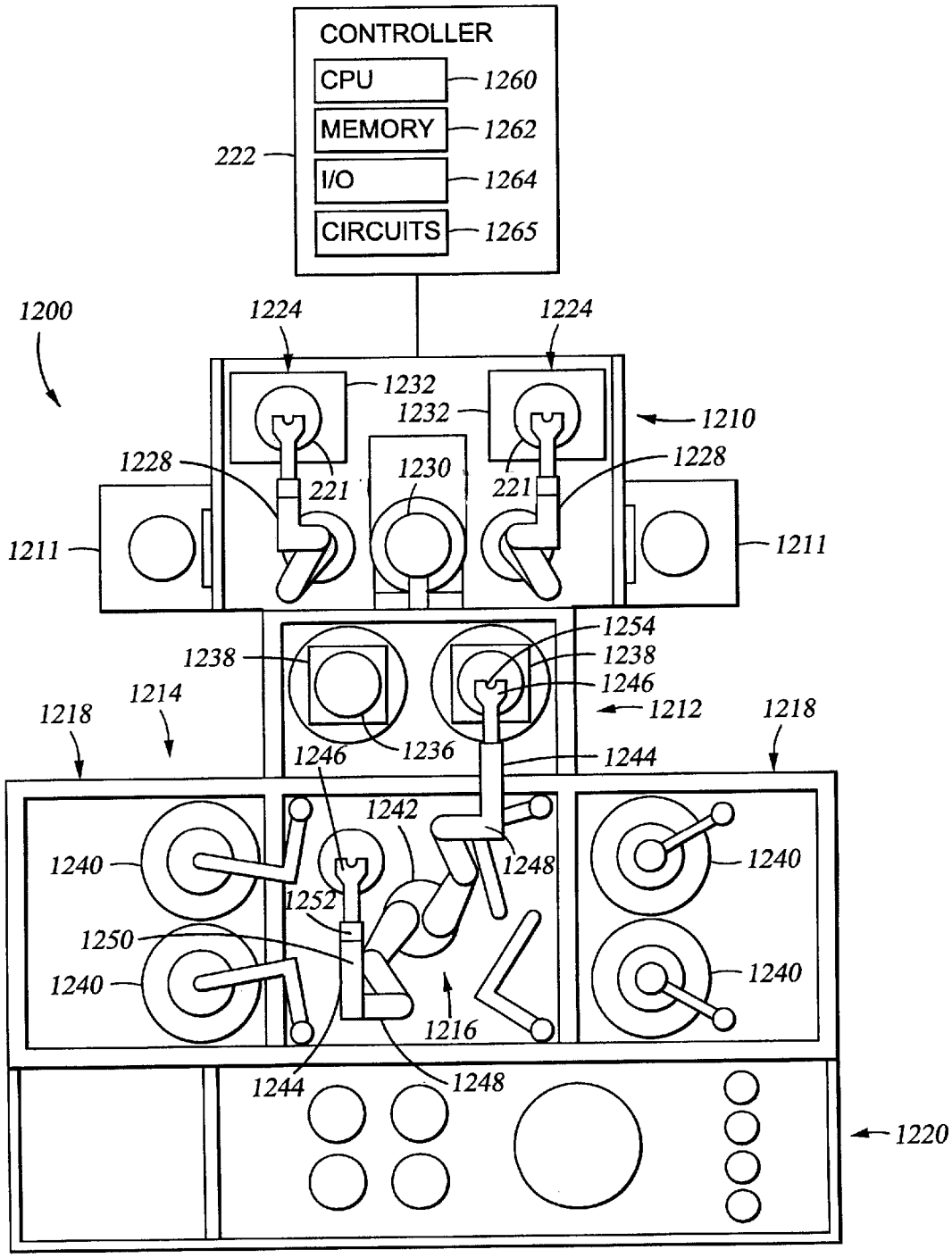
FIG. 1B is a top view of the ECP system of FIG. 1A.

FIG. 1A is a side partial cross-sectional view of one embodiment of an ECP system 1200. FIG. 1B is a top plan view of the ECP system 1200. Referring to both FIGS. 1A and 1B in combination, the ECP system 1200 generally comprises a loading station 1210, at least one rapid thermal anneal (RTA) chamber 1211, a spin-rinse-dry (SRD) station 1212, a mainframe 1214, and an electrolyte solution system 1220. Preferably, the ECP system 1200 is enclosed in a clean environment that is partially defined using panels such as PLEXIGLAS® (a trademark of the Rohm and Haas Company of West Philadelphia, Pa.). The mainframe 1214 generally comprises a mainframe transfer station 1216 and a plurality of processing stations 1218. Each processing station 1218 includes one or more wet process cells 1240. The electrolyte solution system 1220 is positioned adjacent the ECP system 1200 and is fluidly connected to the individual wet process cells 1240 to circulate electrolyte solution used for the electroplating process to each wet process cell. The ECP system 1200 also includes a controller 222 that typically comprises a programmable microprocessor.

The loading station 1210 preferably includes one or more substrate cassette receiving areas 1224, one or more loading station transfer robots 1228, and at least one substrate orientor 1230. The number of substrate cassette receiving areas, loading station transfer robots 1228, and substrate orientors 1230 included in the loading station 1210 can be selected according to the desired throughput of the system. In the embodiment shown in FIGS. 1A and 1B, the loading station 1210 includes two substrate cassette receiving areas 1224, two loading station transfer robots 1228, and one substrate orientor 1230. Each substrate cassette receiving area 1224 includes a substrate cassette 1232. Substrates 221 are loaded/unloaded to the substrate cassette 1232 to remove/introduce substrates 221 into the ECP system. The loading station transfer robot 1228 transfers substrates 221 between the substrate cassette 1232, and the substrate orientor 1230. The loading station transfer robot 1228 comprises a typical transfer robot commonly known in the art. The substrate orientor 1230 positions each substrate 221 in a desired substantially horizontal angular orientation to ensure that the substrate is in proper orientation (the substrates notch, flatted surface, or other such orienting surface is at a desired angle) for subsequent processing or transfer. The loading station transfer robot 1228 transfers substrates 221 between the loading station 1210, the SRD station 1212, and the RTA chamber 1211.

The controller 222 shown in the embodiment of FIG. 1B comprises a central processing unit (CPU) 1260, a memory 1262, a circuit portion 1265, an input output interface (I/O)

1264, and a bus not shown. The controller 222 may be a general-purpose computer, a microprocessor, a microcontroller, or any other known suitable type of computer or controller. The CPU 1260 performs the processing and arithmetic operations to control the operation of the electricity applied to the anode 16, the substrate seed layer 15, the substrate holder system 14, and the robots 1228 and 1242.

The memory 1262 includes random access memory (RAM) and read only memory (ROM) that together store the computer programs, operands, operators, dimensional values, system processing temperatures and configurations, and other parameters that can be used during the electroplating operation. The bus, not shown, provides for digital information transmissions between CPU 1260, circuit portion 1265, memory 1262, and I/O 1264. The bus also connects I/O 1264 to the portions of the ECP system 1200 that either receive digital information from, or transmit digital information to, the controller 222.

I/O 1264 provides an interface to control the transmissions of digital information between each of the components in controller 222. I/O 1264 also provides an interface between the components of the controller 222 and different portions of the ECP system 1200. Circuit portion 1265 comprises all of the other user interface devices, such as display and keyboard, system devices, and other accessories associated with the controller 222. While one embodiment of digital controller 222 is shown and described herein, other digital controllers as well as analog controllers could function well in this application.

The SRD station 1212 is positioned between the loading station 1210 and the mainframe 1214. The structure and operation of the SRD station 1212, as well as the overall structure and operation of one embodiment of an ECP system, is provided in greater detail in U.S. patent application Ser. No. 09/289,074, filed Apr. 8, 1999, and entitled "ELECTRO-CHEMICAL DEPOSITION SYSTEM" (incorporated herein by reference in its entirety). The mainframe 1214 generally comprises a mainframe transfer station 1216 and a plurality of processing stations 1218, referring to FIGS. 1A and 1B. The mainframe transfer station 1216 includes a mainframe transfer robot 1242. Preferably, the mainframe transfer robot 1242 comprises a plurality of individual robot arms 1244 that provides independent access of substrates positioned within the processing stations 1218 or the SRD stations 1212. The number of robot arms 1244 preferably corresponds to the number of wet process cells 1240 per processing station 1218. Each robot arm 1244 includes a robot blade 1246 for holding a substrate during a substrate transfer. Preferably, each robot arm 1244 is operable independently of the other arm to facilitate independent transfers of substrates in the system. Alternatively, the robot arms 1244 may operate in a linked fashion such that one robot extends as the other robot arm retracts.

Preferably, the embodiment of mainframe transfer station 1216 shown in FIG. 1B includes one or more flipper robots 1248 that are designed to facilitate "flipping" of a substrate from a face-up position on the robot blade 1246 of the mainframe transfer robot 1242 to the face down position normally required for processing in a wet process cell 1240. The flipper robot 1248 includes a main body 1250 and a flipper robot arm 1252. The main body 1250 provides both vertical and rotational movements to transfer a substrate within a horizontal plane. The flipper robot arm 1252 provides rotational movement along the axis of the flipper robot arm 1252 that can "flip" the substrate to invert a substrates upper and lower surface. Flipper robots are generally known in the art and can be attached as end effectors for substrate handling robots, such as model RR701, available from Rorze Automation, Inc. of Milpitas, Calif. Preferably, a vacuum suction gripper 1254, disposed on the flipper robot arm 1252, holds the substrate as the substrate is flipped and transferred by the flipper robot 1248. The flipper robot 1248 positions a substrate 221 into the wet process cell 1240 for face-down processing.

Figure 2:
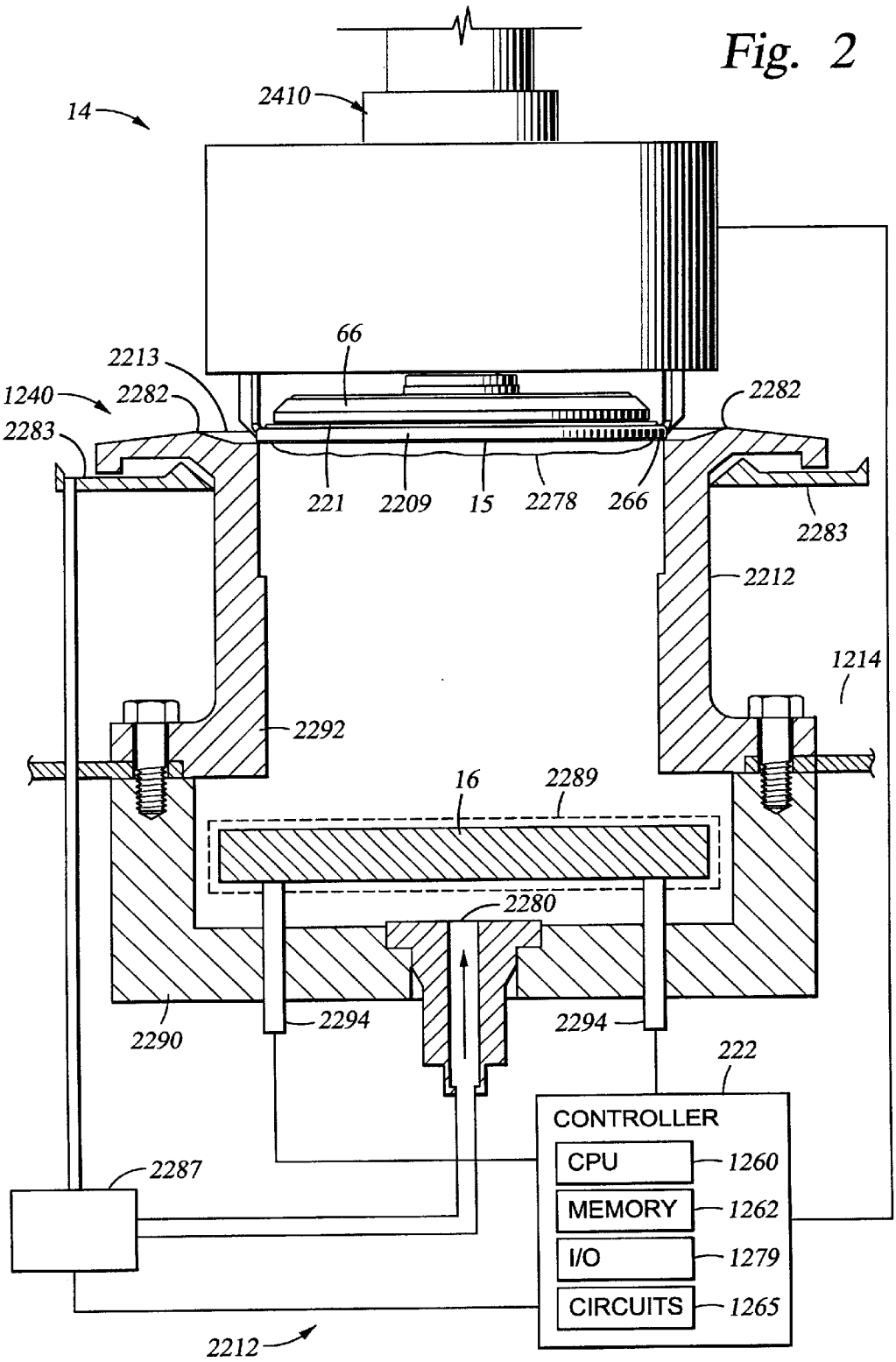
FIG. 2 is a side cross sectional view of one embodiment of process cell to be used in the electrochemical plating (ECP) system of FIG. 1A.

FIG. 2 shows a side cross-sectional view of one embodiment of a wet process cell or electrolyte cell 1240 used in an ECP system 1200, shown schematically in FIGS. 1A and 1B. In this disclosure, a wet process cell is considered any process cell that contains a liquid during processing. The wet process cell 1240 comprises an electrolyte cell 2212. The electrolyte cell 2212 used during ECP processing contains electrolyte solution during processing, and the electrolyte cell has an upper opening 2213. A substrate holder system 14 securely holds a substrate 221 so the substrate can be immersed into, or removed from, the electrolyte solution through an upper opening 2213 of the electrolyte cell. An anode 16 is mounted within the electrolyte cell 2212.

The electrolyte cell 2212 comprises an anode base 2290 and an upper electrolyte cell 2292. The upper electrolyte cell 2292 and the anode base 2290 are removably attached to the mainframe 1214 by fasteners, and can be removed for anode replacement and/or repair. The anode is typically formed and/or machined as a solid piece of copper. The anode 16 is secured within, and relative to, the anode base 2290 by anode supports 2294. One or more feed throughs, that may be contained in the anode supports, supply electric power to the anode 16 under the control of the controller 222. Alternatively, the sides of the anode may be mounted to the interior sides of the electrolyte cell 2212, e.g., at the anode base 2290. In this alternative configuration, feed throughs would extend to the anode from the controller through the side of the electrolyte cell 2212.

The seed layer is formed from a metal, e.g., copper, and is applied to the selected substrate surfaces on which the metal film is to be deposited. Once the seed layer is immersed in the electrolyte solution, it is charged with a sufficient negative voltage relative to the anode that has electrolyte solution forming an electric bridge therebetween, to cause the metal ions to deposit on the seed layer and provide the metal film deposition. Such voltage between the anode and the substrate seed layer that causes plating is known as the "plating voltage". Applying the plating voltage across the electrolyte solution, containing copper sulfate, is sufficient to break the ionic bonds between the positively charged copper ions and the negatively charged sulfate ions within some portions of the electrolyte solution known as a depletion region 2278. A large number of positively charged copper ions are attracted to and thereupon deposit on, the negatively charged seed layer. The deposited metal ions form as metal film on the seed layer. The metal film deposition results primarily from diffusion of the copper ions within the electrolyte solution. The deposition of the copper ions results in the reduction of copper ions within the depletion region during the plating process.

The electrolyte solution voltages adjacent the seed layer are relatively small, on the order of 1 volt. Higher voltages between the anode and the substrate seed layer force more ions into the electrolyte solution. The deposition rate of the metal film on the seed layer is a function of the voltage applied between the anode and the seed layer. Above a diffusion limit that relates to the specific anode, the diffused ions contained in the electrolyte solution are converted into copper ions. A further increase in the voltage between the anode and the seed layer however eventually results in breaking down the bonds of the water in the electrolyte solution. Such an increase in voltage above the diffusion limit does not improve the deposition rate of the metal film on the seed layer.

The anodes are configured with appropriate side passages, etc. so electrolyte solution can flow from an electrolyte solution inlet port 2280 vertically within the electrolyte cell 2212 past the anode 16. The upper electrolyte cell is generally cylindrical, and is oriented perpendicular to both the anode and the substrate. This upper electrolyte cell configuration ensures that electric flux lines that extend from the anode through the electrolyte solution to the seed layer of the substrate 221 are substantially perpendicular to the seed layer of that substrate 221. The substantially perpendicularity of the electric flux lines enhance the uniformity of the electric current density applied to the substrate seed layer, resulting in an enhanced uniformity of metal film deposition across the substrate seed layer.

The substrate holder assembly 2450 can be vertically and/or laterally displaced by the substrate holder system 14 to displace a substrate 221 between one position in which the substrate is immersed in the electrolyte solution contained in an electrolyte cell 2212 and another position where the substrate is removed from the electrolyte cell. The substrate holder assembly 2450 can displace a substrate vertically, or tilt a substrate from horizontal, to suitably position the substrate 221 between the various attitudes and positions necessary for immersion or removal from the electrolyte solution. Such attitudes and positions of the substrate assist during loading and unloading of the substrate 221 into the ECP system 1200, during the processing, or during spinning of the substrates removed from the ECP system following processing. The substrate holder assembly 2450 can be positioned so substrates can be loaded, or unloaded, into the substrate holder assembly 2450 by a robot.

The flow of electrolyte solution within the electrolyte cell 2212 is upward towards the substrate, and the electrolyte solution flows around the substrate. Each of multiple embodiments of hydrophilic membranes is provided to filter particulate matter produced by the anode from the electrolyte solution. In one embodiment, a hydrophilic membrane 2289 is fashioned as a bag that surrounds and encloses the anode 16. The chemical reaction of the electrolyte solution with the anode results in the generation of metal ions into the electrolyte solution. A by-product of this chemical reaction is a release of anode sludge. The hydrophilic membrane 2289 filters out particulate matter from the electrolyte solution while permitting metal ions generated by anode 16 to be carried in the electrolyte solution to pass from the anode 16 to the substrate 221. In another embodiment, the hydrophilic membrane may be extended across the electrolyte cell. In such an embodiment, the hydrophilic membrane would be secured to the inner surface of the electrolyte cell by a suitable bracket.

The electrolyte solution is recirculated and replenished to maintain the desired chemistry adjacent to the substrate seed layer. Electrolyte solution is supplied to electrolyte cell 2212 via the electrolyte solution inlet port 2280. A generally upward flow of refreshed electrolyte solution is provided from the electrolyte solution inlet port 2280 to the annular weir 2282 within the electrolyte cell 2212. The displaced electrolyte solution in the electrolyte cell 2212 overflows the annular weir portion 2282 into an annular drain 2283 that, in turn, drains into the recirculation/refreshing element 2287. The recirculation/refreshing element 2287 recirculates the electrolyte solution that has been discharged from the electrolyte cell 2212, via the annular drain 2283, and refreshes the chemicals contained within the electrolyte solution. The refreshed electrolyte solution contains suitable chemicals to perform the metal film deposition process. The refreshed electrolyte solution output from the recirculation/refreshing element 2287 is applied to the electrolyte solution inlet port 2280 to define a closed loop for the electrolyte solution.

The electrolyte solution comprises, e.g., copper sulfate that, when in electrolyte solution and exposed to a plating voltage, dissociates to positively charged copper ions and negatively charged sulfate ions. When the seed layer is charged with a sufficient negative voltage relative to the anode, copper ions from the depletion region 2278 are attracted to, and deposited on, the seed layer on the substrate. The upward flow of electrolyte solution in the electrolyte cell continues to supply refreshed electrolyte solution within the depletion region 2278, and thereby maintains the metal ion deposition process on the seed layer/plating surface. An increase in negative electric voltage of the seed layer relative to the anode, all other factors being identical, usually provides the following results:

a) an increased dimension of the depletion region 2278 within the electrolyte solution;

b) an increased plating current to the seed layer 15 on the substrate 221; and c) an increased metal film deposition rate on the substrate seed layer 15.

If there is no recirculation or replenishment within the electrolyte cell 2212, eventually the size of the depletion regions 2278 would expand, as more metal ions from the electrolyte solution are deposited on the seed layer over time to form the metal film. An increased depletion region 2278 results in diminished plating. Maintaining a flow of refreshed electrolyte solution past the seed layer thereby refreshes the chemicals in the electrolyte solution, and maintaining the metal film deposition on the substrate seed layer.

2. Substrate Holder System Structure and Operation

Figure 3A:
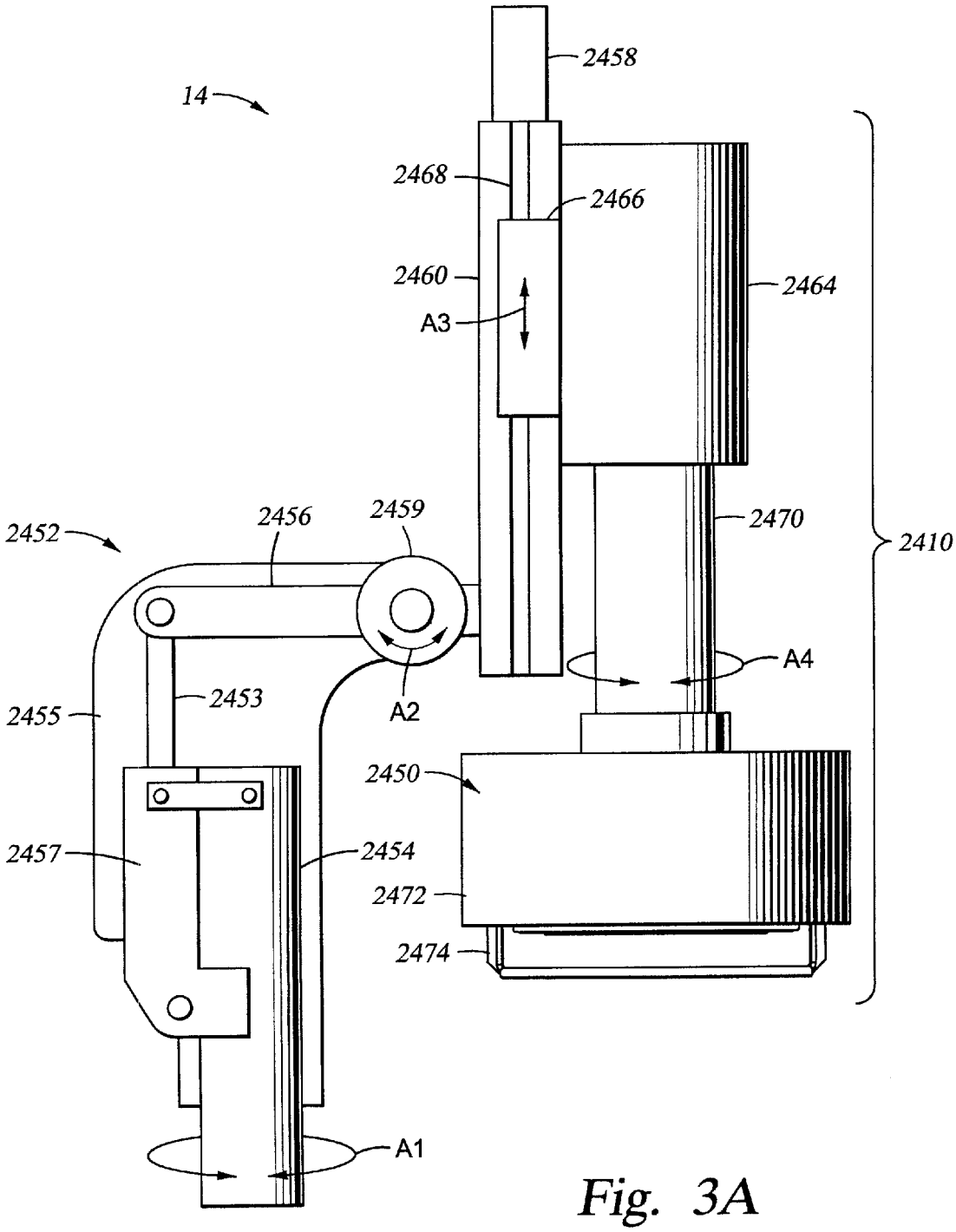
FIG. 3A is a cross sectional view of one embodiment of the substrate holder system to be used with the process cell of FIG. 2.
Figure 3B:
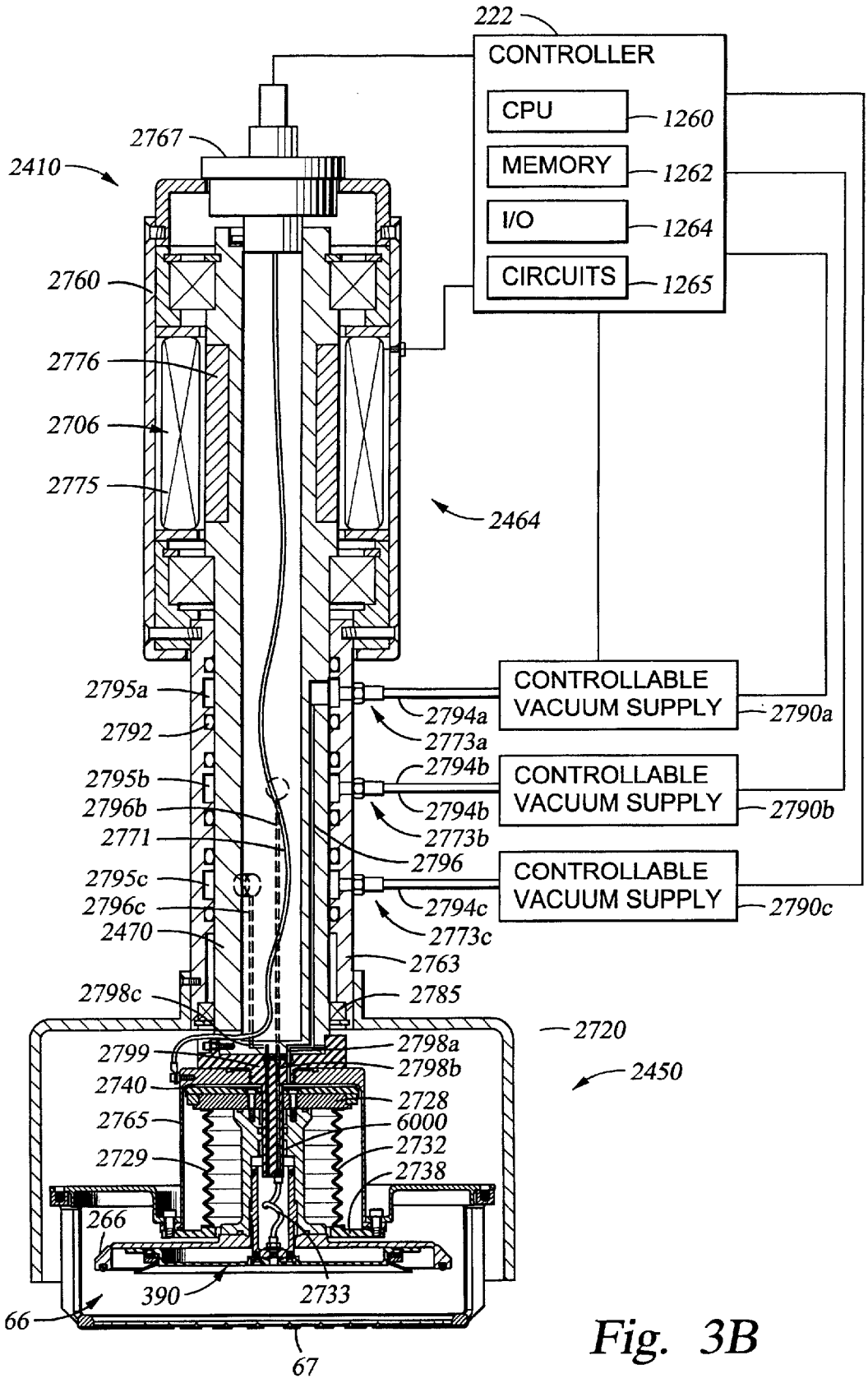
FIG. 3B is a cross sectional view of one embodiment of a rotatable head assembly of the substrate holder assembly of FIG. 3A.

The embodiment of a substrate holder system 14 partially shown in FIG. 2 is shown in greater detail in FIG. 3A. This embodiment of substrate holder system 14 may provide for one or more of translation of the substrate holder assembly in a horizontal X-direction, translation of the substrate holder assembly in a vertical Z-direction, and for tilting of the substrate. This embodiment of rotatable head assembly 2410 shown in FIGS. 3A and 3B provides for rotation of the substrate holder assembly to effect rotation of the substrate during immersion of the substrate into the electrolyte solution where the substrate is held by the substrate holder assembly. The substrate holder system 14 includes the rotatable head assembly 2410 and a head assembly frame 2452. The head assembly frame 2452 includes a mounting post 2454, a shaft 2453, a post cover 2455, a cantilever arm 2456, a cantilever arm actuator 2457, and a pivot joint 2459. The mounting post 2454 is mounted onto the body of the mainframe 1214, and the post cover 2455 covers a top portion of the mounting post 2454.

Preferably, the mounting post 2454 provides rotational movement, of the head assembly frame 2452 about a substantially vertical axis that extends through the mounting post in a direction indicated in FIG. 3A by arrow A1. Such motion is generally provided to align the head assembly 2410 with the electrolyte cell.

One end of the cantilever arm 2456 is pivotally connected to the shaft 2453 of the cantilever arm actuator 2457. The cantilever arm actuator 2457 is, for example, a pneumatic cylinder, a lead-screw actuator, a servo-motor, or another known type of actuator. The cantilever arm 2456 is pivotally connected to the mounting slide 2460 of the rotatable head assembly 2410 at the pivot joint 2459. The cantilever arm actuator 2457 is mounted to the mounting post 2454. The pivot joint 2459 is rotatably mounted to the post cover 2455 so that the cantilever arm 2456 can pivot about the post cover at the pivot joint. Actuation of the cantilever arm actuator 2457 provides pivotal movement, in a direction indicated in FIG. 3A by arrow A2, of the cantilever arm 2456 about the pivot joint 2459. Alternatively, a rotary motor may extend directly between the head assembly frame 2452 and the mounting slide 2460 to act as a cantilever arm actuator 2457, wherein output of a rotary motor is connected to cause rotation of the head assembly 2410 about the pivot joint as shown by arrow A2.

The rotatable head assembly 2410 is attached to a mounting slide 2460 at the head assembly frame 2452. The mounting slide 2460 is disposed at the distal end of the cantilever arm 2456. Rotation of the rotatable head assembly 2410 about the pivot joint 2459 causes tilting of a substrate held within the substrate holder assembly 2450 of the rotatable head assembly 2410 about the pivot joint 2459. When the cantilever arm actuator 2457 is retracted, the cantilever arm 2456 raises the head assembly 2410 away from the electrolyte cell 2212 as shown in FIG. 2. This tilting of the rotatable head assembly 2410 effects tilting of the substrate relative to horizontal. Such tilting of the substrate can be used during removal and/or immersion of the substrate holder assembly from/to the electrolyte solution within the electrolyte cell 2212 without air pockets forming under the substrate/substrate holder assembly combination. When the cantilever arm actuator 2457 is extended, the cantilever arm 2456 rotates the head assembly 2410 toward the electrolyte cell 2212 to displace the substrate, in a tilted orientation, into the electrolyte cell. Certain embodiments of substrate holder systems 14 do not provide a mechanism for tilting the substrate from horizontal. The substrate is preferably in a substantially horizontal position during ECP.

The rotatable head assembly 2410 includes a rotating actuator 2464 slidably connected to the mounting slide 2460. The mounting slide 2460 guides the vertical motion of the rotatable head assembly 2410. The shaft 2468 of the head lift actuator 2458 is inserted through a lift guide 2466 attached to the body of the rotating actuator 2464. Preferably, the shaft 2468 is a lead-screw type shaft that is actuated to displace the lift guide 2466, and the connected rotatable head assembly 2410, in a substantially vertical direction indicated in FIG. 3A by arrow A3. A head lift actuator 2458 is disposed on the mounting slide 2460 to provide motive force for vertical displacement of the head assembly 2410 by rotating the shaft 2468. This vertical displacement of the rotatable head assembly 2410 can be used to remove and/or replace the substrate holder assembly from the electrolyte cell 2212. Removing the substrate from the electrolyte cell is necessary to position the substrate so that a robot, not shown, can remove the substrate from the rotatable head assembly 2410.

The rotating actuator 2464 is connected to the substrate holder assembly 2450 through the shaft 2470 and rotates the substrate holder assembly 2450 in a direction indicated by arrow A4. The rotation of the substrate during the electroplating process generally enhances the deposition results. Preferably, the head assembly rotates the substrate about the vertical axis of the substrate during metal film deposition, when the substrate is immersed in the electrolyte solution, between about 0 RPM and about 500 RPM, and more particularly between about 10 RPM and about 40 RPM. Rotation of the substrate at a higher angular velocity may result in turbulence within the electrolyte solution. The head assembly can also be rotated as the head assembly is lowered to position the substrate in contact with the electrolyte solution in the process cell as well as when the head assembly is raised to remove the substrate from the electrolyte solution in the process cell. The head assembly is preferably spun at a high speed, e.g., up to about 3000 RPM, after the head assembly is lifted from the process cell. Such spinning of the substrate following the removal of the substrate from the electrolyte solution enhances removal of residual electrolyte solution on the substrate and/or the substrate holder assembly 2450 by the centrifugal force applied to the liquid on the substrate.

FIG. 3B shows a cross sectional view of one embodiment of rotatable head assembly 2410 of the substrate holder system 14 shown in FIG. 3A. The rotatable head assembly 2410 provides for such actions as rotation of the substrate, and vertical displacement of the thrust plate 66 relative to the electric contact elements 67 to position a substrate, when the substrate is positioned between the thrust plate and the electric contact elements, in contact with the electric contact element 67. The thrust plate 66 can be raised to provide a space between the thrust plate 66 and the electric contact element 67 to permit removal of the substrate from, or insertion of the substrate into, a substrate holder assembly 2450. The rotatable head assembly 2410 comprises the substrate holder assembly 2450, the rotating actuator 2464, a shaft shield 2763 (not shown in FIG. 3A), a shaft 2470, an electric feed through 2767, an electric conductor 2771, and a plurality of vacuum sources 2773*a*, 2773*b*, and 2773*c*. The rotating actuator 2464 comprises a head rotation housing 2760 and a head rotation motor 2706. The head rotation motor 2706 comprises a coil segment 2775 and a magnet rotary element 2776. The hollow coil segment 2775 is configured to generate a magnetic field that acts to rotate the magnetic rotary element 2776 about a vertical axis to provide the rotational displacement of the head rotation motor to the shaft 2470. The substrate holder assembly 2450 comprises a fluid shield 2720, a contact housing 2765, the thrust plate 66, the electric contact element 67, and a spring assembly 2732.

The contact housing 2765 and the spring assembly 2732 are generally annular, and these two elements interfit, and provide for a combined rotation that is transferred to the thrust plate 66 and the electric contact element 67. The spring assembly 2732 comprises an upper spring surface 2728, a spring bellow connector 2729, and a lower spring surface 2738.

Electricity is supplied to the electric contact element 67 that contacts the seed layer on a substrate to provide a desired voltage between the anode 16 and the seed layer on the substrate to effect the electroplating. Electricity is supplied from the controller 222 to the electric contact element 67 via the electric feed through 2767, the electric conductor 2771, and the contact housing 2765. The electric contact element 67 is in physical, and electric, contact with the seed layer on the substrate when the substrate is positioned on the electric contact element. The shaft 2470, the contact housing 2765, the spring assembly 2732, the thrust plate 66, the electric contact element 67, the rotary mount 2799, and the substrate 221 (secured between the thrust plate 66 and the electric contact element 67) all rotate as a unit about a longitudinal axis of the head assembly 2410. The head rotation motor 2706 provides the motive force to rotate the above elements about its vertical axis.

Three vacuum sources 2773*a*, 2773*b*, and 2773*c* are included in the rotatable head assembly 2410, and each vacuum source is individually controlled by the controller 222. The first vacuum source 2773*a* applies a controllable vacuum to control the vertical position of the thrust plate 66 relative to the electric contact element 67. The second vacuum source 2773*b* applies a controllable vacuum to controllably hold a substrate to a substrate extension unit 390. The third vacuum source 2773*c* applies a controllable vacuum to displace the substrate extension unit 390 in a vertical direction relative to a main thrust plate portion 266. The structure of the first vacuum source 2773*a* is now described, and provided with appended reference character "a". The corresponding structure of the second vacuum source 2773*b* and the third vacuum source 2773*c* are provided with respective appended reference characters "b" and "c", and operate in a similar manner to that described for the corresponding component of the first vacuum source 2773*a*. Through this description relates to three vacuum sources 2773*a*, 2773*b*, and 2773*c*, it is envisioned that if the corresponding direction of displacements and biasing is reversed, then one or more of the vacuum sources can be replaced by a pressure source.

The first vacuum source 2773*a* controllably supplies a vacuum to portions of the rotatable head assembly 2410 to control the position of the thrust plate relative to the electric contact element 67. The first vacuum source 2773*a* supplies the vacuum to the pressure reservoir 2740 partially defined by an upper spring surface 2728, and comprises a controllable vacuum supply 2790*a*, a sleeve member 2792, a fluid conduit 2794*a*, a circumferential groove 2795*a*, a fluid aperture 2796*a*, and a fluid passage 2798*a*. The pressure reservoir 2740 may be configured to maintain either positive air pressure or vacuum, depending upon the relative biasing and operation of the spring assembly 2732 and the head assembly 2410. For example, the spring assembly 2732 can be biased upward by a vacuum applied to the pressure reservoir 2740. Alternatively, the spring assembly 2732 can be biased downward by pressure applied to the pressure reservoir 2740. The sleeve member 2792 may be a distinct member or a portion of the shaft as shown in FIG. 3B. The circumferential groove 2795*a* extends within the sleeve member 2792 about the circumference of the shaft 2470. The fluid aperture 2796*a* is in fluid communication with the circumferential groove. The fluid aperture 2796*a* extends axially through the shaft 2470 from the circumferential groove 2795*a* to the bottom of the shaft 2470. The fluid passage 2798*a* extends through the rotary mount 2799 within the contact housing 2765 and is in fluid communication with the pressure reservoir 2740. The fluid aperture 2796*a* is also in fluid communication with the fluid passage 2798*a*.

In the first vacuum source 2773*a*, a vacuum is applied from the vacuum supply 2790*a* via the fluid conduit 2794*a* to the inner surface of the sleeve member 2792 and the circumferential groove 2795*a*. The vacuum is applied from the fluid aperture 2796*a* to the fluid passage 2798*a* and the pressure reservoir 2740. The inner surface of the sleeve member 2792 has a small clearance, e.g., about 0.0002 inch, with the outer surface of the shaft 2470 to allow relative rotation between these two members. Due to the tight clearance between the sleeve member 2792 and the shaft 2470, a vacuum applied to the inner surface of the sleeve member 2792 extends via the circumferential groove 2795*a* to the fluid aperture 2796*a*. The tight clearance limits air entering, and the vacuum escaping, between the sleeve member 2792 and the outer surface of the shaft 2470. Therefore, the vacuum applied from the controllable vacuum supply 2790*a* passes through the fluid passage 2798*a* and the rotary mount 2799 to the pressure reservoir 2740 formed between the spring assembly 2732 and the contact housing 2765. The vacuum applied by the controllable vacuum supply 2790*a* thereby controls the vacuum in the pressure reservoir 2740.

The spring bellow connector 2729 attached between the thrust plate 66 and the contact housing 2765, combines certain aspects of a spring and a bellows. The spring bellows connector 2729 limits fluid flow between the thrust plate 66 and the electric contact element 67. The spring bellows connector 2729 additionally exerts a spring biasing force when axially displaced in either a direction to be extended or compressed (e.g., depending upon whether a vacuum or pressure is applied to the pressure reservoir) from its relaxed shape. The spring bellows connector is connected to the thrust plate 66 such that vertical displacement of the spring bellow connector 2729 alters the vertical position of the thrust plate 66 relative to the electric contact element 67. Any suitable type of bellows or baffle member that has a spring constant may be used as spring bellow connector 2729. Alternatively, separate spring and bellows members may be used as the spring bellow connector 2729. The upper spring surface 2728 is annular shaped and is sealably connected to the thrust plate 66. The lower spring surface 2738 is sealably connected to the contact housing 2765. A pressure reservoir 2740 is in the void created between the contact housing 2765 and the spring assembly 2732. In one embodiment, the thrust plate is normally pressed against the backside of the substrate by the spring tension exerted by the spring bellow connector 2729. Application of the vacuum within the pressure reservoir 2740 raises the upper spring surface 2728 of the spring assembly 2732, and thereby also raises the thrust plate 66 that is rigidly connected to the upper spring surface 2728.

The second vacuum source 2773*b* controllably applies a fluid vacuum from the controllable vacuum supply 2790*b* to the lower side of the substrate extension portion 390 via fluid conduit 2794*b*, circumferential groove 2795*b*, fluid aperture 2796*b*, fluid passage 2798*b* formed in the rotary mount 2799, and hose connector 2733. The vacuum applied from the controllable vacuum supply 2790*b* of the second vacuum source 2773*b* controllably secures a substrate to the underside of the substrate extension portion 390.

The third vacuum source 2773*c* controllably applies a fluid vacuum from the controllable vacuum supply 2790*c* via fluid conduit 2794*c*, circumferential groove 2795*c*, fluid aperture 2796*c*, and fluid passage 2798*c* formed in the rotary mount to a vacuum reservoir 393 between the substrate extension mount 391 and the plunger rod 330. The vacuum applied from the controllable vacuum supply 2790*c* of the third vacuum source 2773*c*, extends the substrate extension unit 390 relative to the main thrust plate portion 266 in a substantially vertical direction.

The thrust plate 66 is displaced to a raised position by actuation of the first vacuum source 2773*a* when a robot, not shown, is loading or unloading a substrate 221 onto the electric contact element 67. Following insertion by the robot, the substrate 221 rests upon the contact element such that the periphery of the plating surface of the substrate 221 rests upon the contact element. The thrust plate 66 is then lowered firmly against the upper surface of the substrate 221 by actuation of the first vacuum source 2773*a* to ensure a snug contact between the plating surface of the substrate 221 and the electric contact element 67. Electricity can be applied under control of the controller 222 to the seed layer on the substrate 221.

The substrate holder assembly 2450 is configured to hold a substrate 221 in a secured position such that the substrate can be moved between the exchange, dry, and process positions while the substrate remains within the substrate holder assembly and in contact with the electric contact elements. The thrust plate 66 can be biased downwardly, by deactuation of the first vacuum source 2773*a*, to secure a substrate 221 against the electric contact element 67. In the embodiment shown in FIG. 3B, upward displacement to the thrust plate is provided by a vacuum applied to within the pressure reservoir 2740 by the controllable vacuum supply 2790. The vacuum in the pressure reservoir 2740 causes the upper spring surface 2728, the remainder of the spring assembly 2732, and the attached thrust plate 66 to be displaced upwardly.

The thrust plate 66 can be biased upward by actuation of the first vacuum source to provide a space between the thrust plate 66 and the electric contact element 67, and through which a substrate can be inserted by the robot device. Reducing the vacuum from the controllable vacuum supply 2790 allows the spring bellow connector 2729 to return the upper spring surface 2728 to the latter's normal lowered position by which the upper spring surface 2728 biases the attached thrust plate 66 into secure contact with a substrate 22 positioned on the electric contact element 67. This physical biasing of the substrate against the electric contact element 67 is sufficient to enhance the electric contact between the electric contact element 67 and the seed layer on the substrate 221. The electric contact element 67 extends about the periphery of the seed layer on a substrate inserted in the substrate holder assembly, and is electrically biased relative to the anode 16 shown in the embodiment of FIG. 2 to effect metal deposition on the seed layer. The thrust plate 66, the electric contact element 67, the spring assembly 2732, and a substrate inserted on the electric contact element all rotate relative to the non-rotating fluid shield 2720.

The head rotation motor 2706 is mounted within, and at least partially extends through, the inner circumference of the hollow head rotation housing 2760 and is connected to the shaft 2470. The hollow coil segment 2775 is mounted to, and remains substantially stationary relative to, the inside of the hollow head rotation housing 2760. The shaft 2470 includes a magnet portion 2777 that can be rotated about a vertical axis. The magnet portion 2777 is physically disposed within the hollow portion of the hollow coil segment 2775. The hollow coil segment 2775 induces rotation in the magnet portion 2777 and the connected shaft 2470. Bearings 2785 are provided between shaft shield 2763 and the shaft 2470 to provide rotational support of the shaft 2470 about a vertical axis. The shaft 2470 is connected at its lower end to certain portions of the substrate holder assembly 2450 including a thrust plate 66 and a substrate 221 held between the thrust plate and the electric contact element 67 to provide rotational motion. The head rotation motor 2706 may be of the type that produces output rotation in the range from, for example, 0 RPM to about 3000 RPM under the control of the controller 222.

The fluid shield 2720 is optional, and when used it may be disposed about the periphery of, and preferably spaced from, the substrate holder assembly 2450. The fluid shield restricts electrolyte solution or other matter that may spray on other equipment or in undesired locations under the effects of centrifugal rotation of the substrate holder assembly 2450 to other adjacent equipment.

The thrust plate includes two interacting segments: the main thrust plate portion 266 and the substrate extension unit 390. The ECP system 1200 includes an electrolyte cell 2212 that contains the electrolyte solution. In a preferred embodiment, during processing, the substrate extension unit 390 and the main thrust plate portion 266 are substantially positioned in a single plane, and both contact the backside of a substrate. The substrate extension unit 390 and the main thrust plate portion 266 physically force the substrate 221 against the electric contact element 67 with a substantially even pressure applied around the periphery of the substrate. Following processing, the substrate holder system removes the substrate, that is held within the substrate holder assembly 2450 during processing, from the electrolyte cell.

The substrate extension unit 390 is displacably positioned within a spin recess 389 formed within the main thrust plate portion 266. The substrate extension unit 390 can be controllably displaced relative to the main thrust plate portion 266, e.g., by actuation of the third vacuum source 2773*c* so the substrate extension unit supports the substrate at a plane that is extended from another plane at which the bottom of the thrust plate is positioned. The substrate extension unit can thereby secure the backside of the substrate by a vacuum created between the substrate extension unit and the substrate in response to actuation of the second vacuum source 2773*b*. The substrate is then rotated in a position vertically removed from the thrust plate when spinning, and drying, the substrate.

Figure 4:
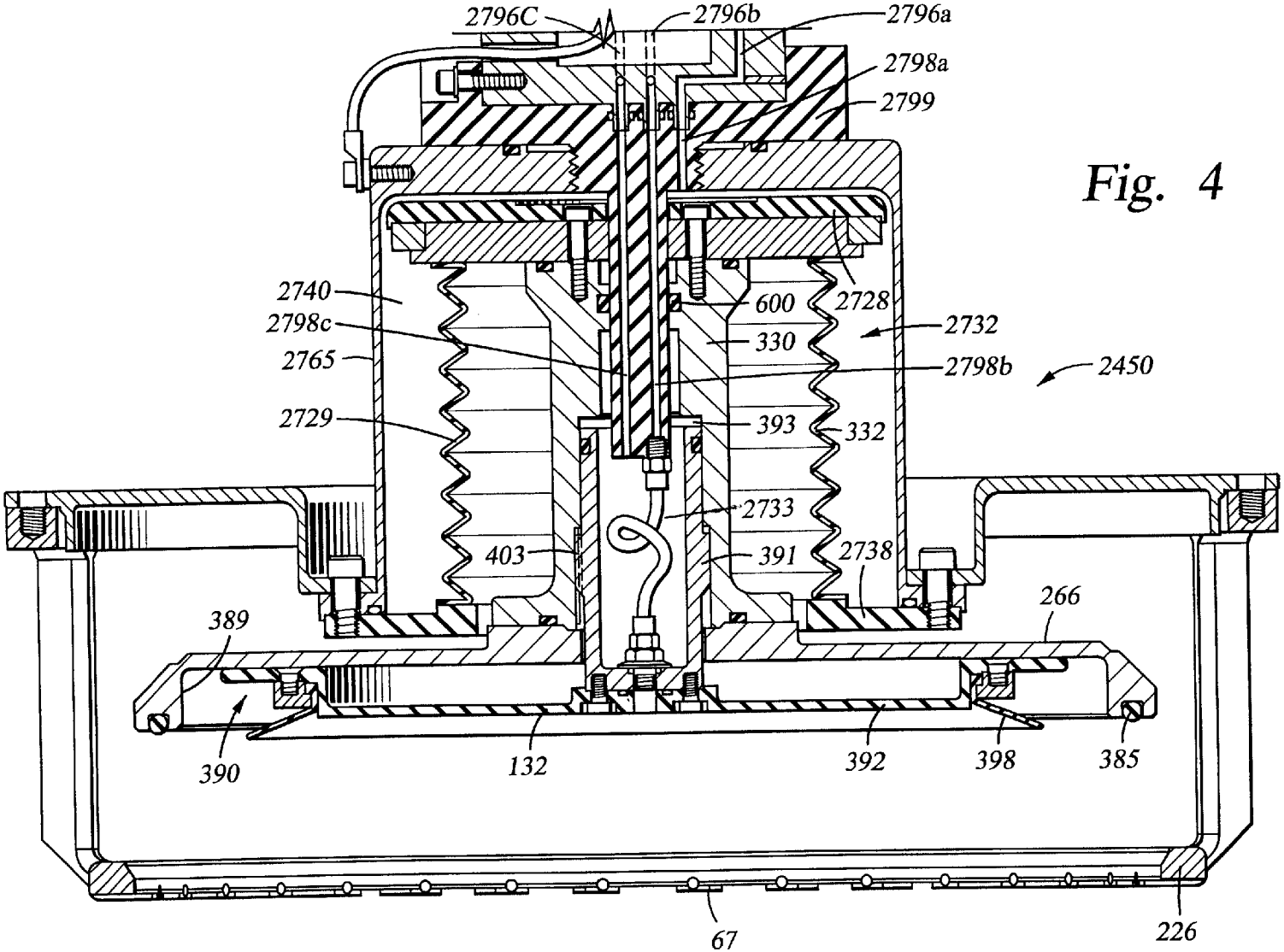
FIG. 4 is an enlarged cross sectional view of one embodiment of substrate holder assembly of the rotatable head assembly shown in FIG. 3B, with the main thrust plate portion raised and the substrate extension unit retracted.
Figure 5:
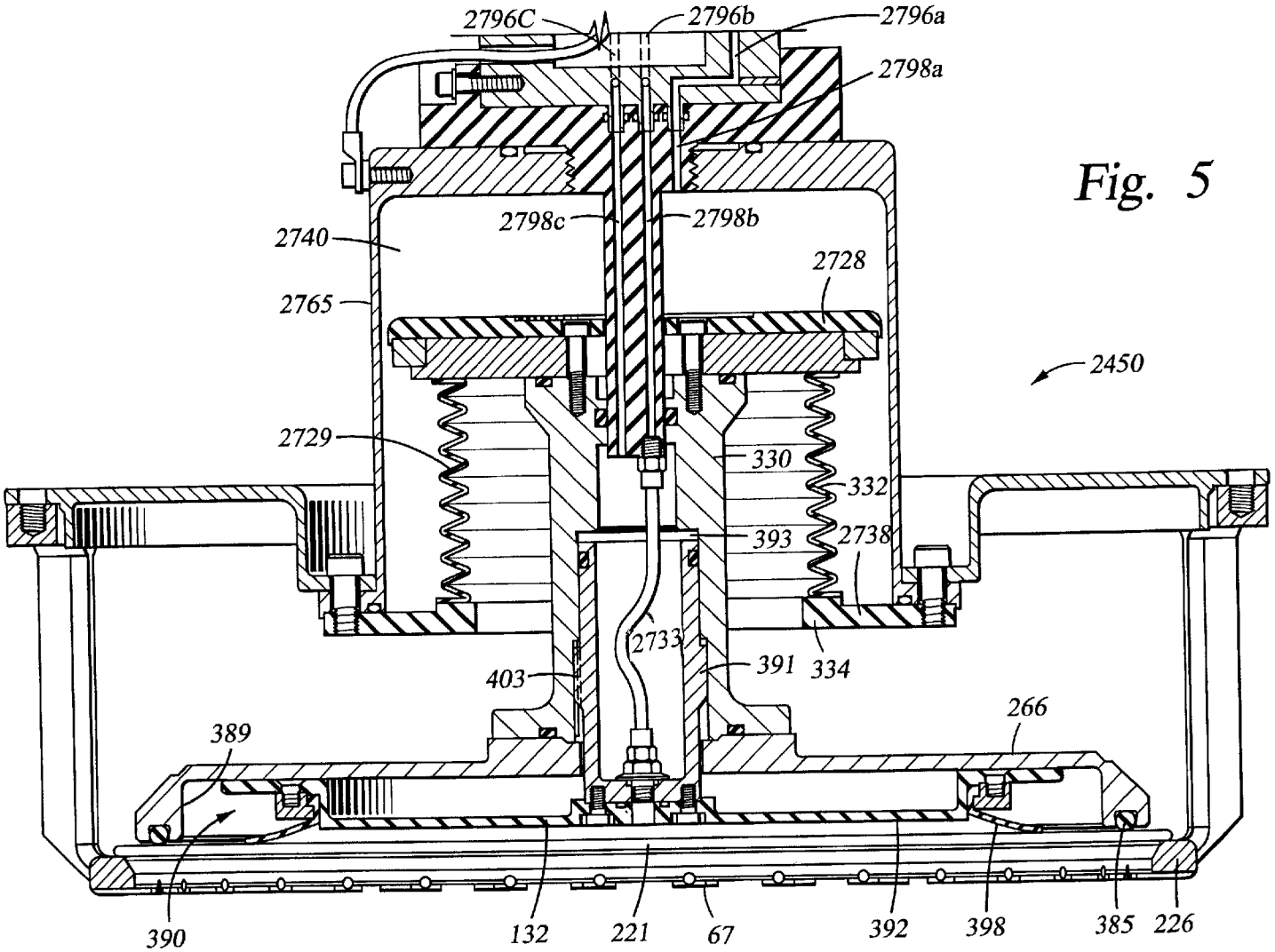
FIG. 5 is the substrate holder assembly of FIG. 4 with the main thrust plate portion lowered and the substrate extension unit retracted.
Figure 6:
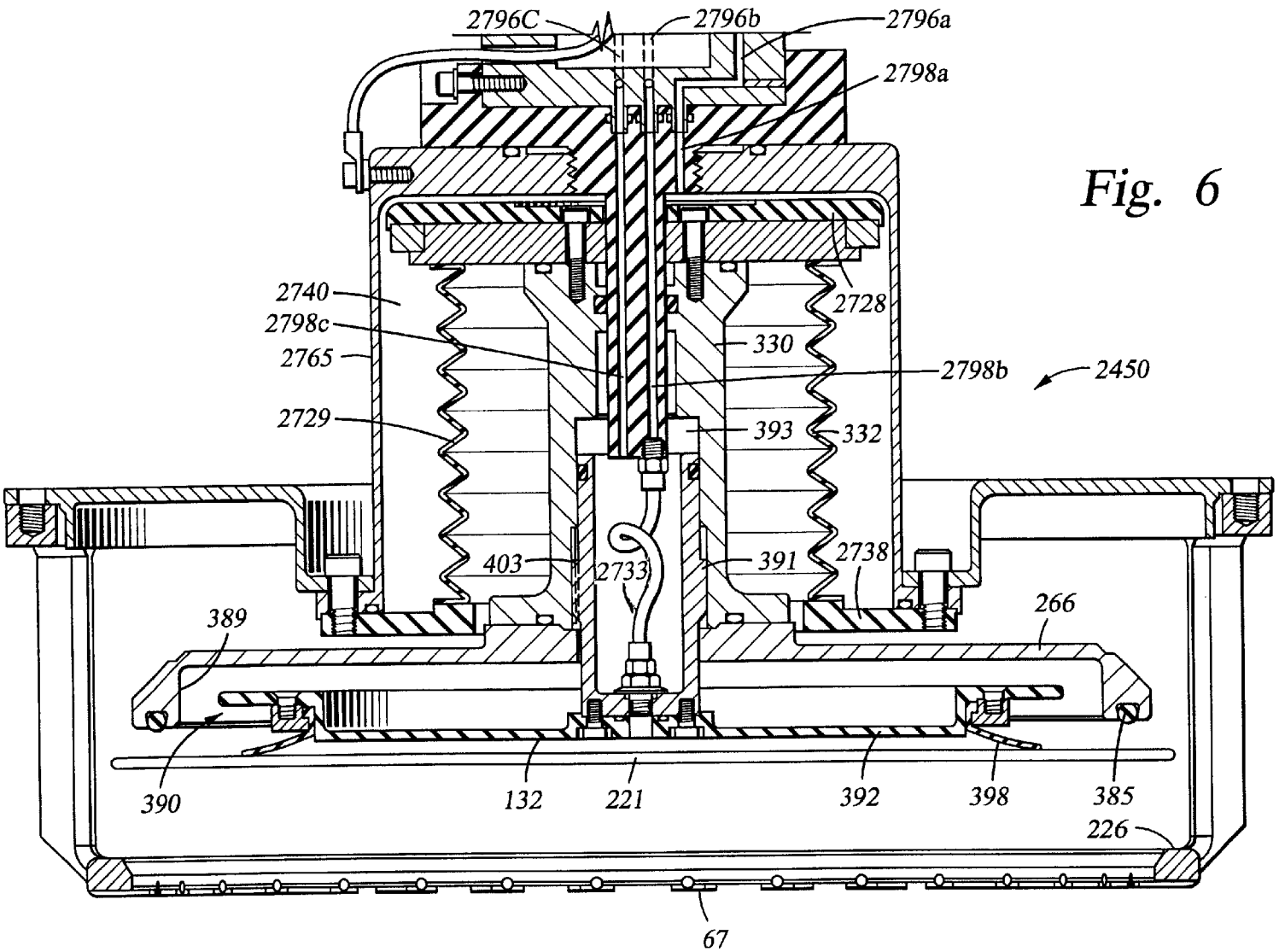
FIG. 6 is the substrate holder assembly of FIG. 4, with the main thrust plate portion raised and the substrate extension unit extended.

FIGS. 4–6 depicts three distinct positions of the main thrust plate portion 266 and the substrate extension unit 390. The substrate extension mount 391 defines a portion of the outer limits of vacuum reservoir 393 formed in the plunger rod 330. The substrate extension mount 391 is attached to, and supplies rotary motion to, the substrate extension unit 390. The rotatable head assembly 2410 of FIG. 3B rotates the rotary mount 2799, the substrate extension mount 391, and the rotatably mating substrate extension unit 390, under the control of controller 222, at a controllable angular velocity that matches the requirements for the substrate. The angular velocity at which the rotatable head assembly 2410 rotates the substrate extension unit 390, and the connected substrate, is sufficient to centrifugally spin off any electrolyte solution remaining on the surfaces of the substrate and/or the surfaces of the substrate holder assembly. The key/groove 403 extends substantially vertically between the substrate extension mount 391 that is connected to the substrate extension unit 390 and the plunger rod 330 that is connected to the main thrust plate portion 266 to limit relative rotation, while permitting vertical displacement, between the substrate extension unit 390 and the main thrust plate portion 266.

The substrate extension unit 390 is configured to contact a substrate 221 during normal electroplating processing, as well as hold the substrate in a position remote from the main thrust plate portion during the spinning that occurs following the normal processing. A vacuum generator 2790 is in fluid communication with the substrate extension unit 390. The vacuum generated by the vacuum generator 2790, by actuation of the second vacuum source 2773*b*, is sufficient to secure the substrate to the substrate extension unit 390. The lip seal 398 enhances the vacuum generated between the substrate extension unit 390 and substrate 221. The substrate extension unit 390 can be displaced between an extended and retracted position within a spin recess 389 formed within the main thrust plate portion 266.

FIGS. 3 and 4 both show the thrust plate in its extended position with the main thrust plate portion 266 raised and the substrate extension unit 390 retracted within spin recess 389 formed in the main thrust plate portion 266. The thrust plate and the substrate extension unit is in this position as the substrate is inserted into, or retracted from the substrate holder assembly. In this position, the first vacuum source 2773*a* is actuated, the second vacuum source 2773*b* is actuated, and the third vacuum source 2773*c* is actuated. FIG. 5 shows thrust plate in its position during normal plating where the main thrust plate portion is lowered and the substrate extension unit 390 is extended from within the spin recess 389 formed in the thrust plate 66. To move the substrate extension unit 390 downwardly relative to plunger rod 330 into its extended position, or upwardly into its retracted position, the second vacuum source 2773*b* is respectively deactuated/actuated. In the FIG. 5 position, the first vacuum source 2773*a* is deactuated, the second vacuum source 2773*b* can be either deactuated or actuated since the substrate is supported on the electric contact element and securing the substrate to the substrate extension unit 390 is optional, and the third vacuum source 2773*c* is actuated. FIG. 6 shows the thrust plate in a position that it is in to spin a substrate to dry the substrate, where the main thrust plate portion is raised, and the substrate extension unit 390 is extended from within the spin recess 389. In this position, the first vacuum source 2773*a* is actuated, the second vacuum source 2773*b* is actuated, and the third vacuum source is deactuated.

The substrate holder assembly 2450 is in the exchange position, as shown in FIG. 4, when a robot is inserting a substrate onto, or removing a substrate from, the substrate holder assembly. Sufficient space exists underneath the lip seals 398 of the substrate extension unit 390 to insert a substrate 221, using a robot, onto the electric contact element 67 when the substrate holder assembly is in the exchange position. To displace the substrate holder assembly 2450 into its exchange position, the upper spring surface 2728 of the spring assembly 2732 is upwardly extended. The upward extension of the upper spring surface 2728 of the spring assembly 2732 vertically raises the thrust plate 66. To extend the upper spring surface 2728, a vacuum is applied within the pressure reservoir 2740 from the controllable first vacuum generator 2790*a*. The application of a vacuum within the pressure reservoir overcomes the spring action of the spring bellow connector 2729, and upwardly displaces the upper spring surface 2728, and the connected thrust plate 66, upward. As the thrust plate 66 is displaced to the exchange position, the substrate extension unit 390 continues to be retracted within the spin recess 389 due to the actuation of the second vacuum source 2773*b*. When the thrust plate is raised and the substrate extension unit 390 is retracted within the spin recess 389, a robot has sufficient room to position a substrate between the substrate extension unit 390 and the contact element and position the substrate 221 on the electric contact element 67. The robot is then retracted from the substrate holder assembly 2450, leaving the substrate on the electric contact elements.

After the robot inserts the substrate on the electric contact element 67, the thrust plate 66, with the substrate extension unit continuing to be retracted within the spin recess 389 formed in the main thrust plate portion 266, is lowered to contact the backside of the substrate by deactuation of the first vacuum source 2773*a*. Such deactuation of the first vacuum source 2773*a* reduces the vacuum in the pressure reservoir 2740, so that the vacuum force within the pressure reservoir against the spring assembly is reduced, thereby allowing the spring action of the spring bellow connector 2729 to force the upper spring surface 2728 and the thrust plate 66 downward. The spring action of the spring bellow connector 2729 provides sufficient force, with the vacuum in the pressure reservoir removed, to bias the substrate into electric contact with the electric contact element 67.

As the substrate 221 is supported by the electric contact element 67, the thrust plate 66, including the main thrust plate portion 266 and the substrate extension unit 390 unit, is lowered into the process position, shown in FIG. 5, so the lip seals 398 of the substrate extension unit 390 contact the substrate 221. As the thrust plate 66 is lowered, the O-ring 385 of the thrust plate 66 also contacts the backside of the substrate 221. Since the substrate extension unit 390 is retracted within the spin recess 389, so the bottom surface of the substrate extension unit is on a plane closely vertically spaced from a plane in which a lower surface of the main thrust plate portion is positioned, the backside of the substrate 221 will be contacting, and slighting deforming, both the O-ring 385 and the lip seal 398 to form a contact that limits passage of electrolyte solution into those segments of the backside of the substrate that are within the O-ring. During processing, rotation is imparted by the rotatable head assembly 2410 shown in FIG. 3B, to the substrate extension unit 390, the main thrust plate portion 266, the electric contact element 67, and the substrate 221 about their substantial vertical axes. The biasing of the O-ring 385 against the backside of the substrate 221 limits access of the electrolyte solution to the backside of the substrate when the substrate is subsequently immersed in the electrolyte solution. The O-ring 385 also limits the formation of metal deposits on the backside of the substrate at those surface locations within the perimeter of the O-ring.

Processing can occur on the substrate when the substrate holder assembly 2450 s lowered into the process position as shown in FIG. 5. During processing the spring bellow connector 2729, the thrust plate 66, and the electric contact element 67 are rotated at an angular velocity of between about 20 RPM and about 500 RPM, preferably between about 10 RPM and about 40 RPM. The rotation of the substrate 221 during processing enhances the uniformity of the deposition of the metal film on the seed layer but is not sufficient to create turbulence between the substrate (or the electric contact elements supporting the substrate) and the electrolyte solution. In the process position, the thrust plate 66, the substrate 221, the substrate extension unit 390, the electric contact element 67, and the spring assembly 2732 can all rotate as a unit.

In an alternate embodiment, the processing can be performed on a stationary substrate 221 wherein the thrust plate 66, the substrate 221, the electric contact element 67, and the spring assembly 2732 do not rotate about a vertical axis. When the substrate 221 is secured in position by the substrate holder assembly 2450, the thrust plate 66 biases the backside of the substrate 221 such that the outer periphery of the front side of the substrate is secured against the electric contact element 67.

The metal ions produced by the reaction between the electrolyte solution and the anode 16, as described above relative to FIG. 2, is deposited on the plating surface or seed layer on the substrate 221 when the substrate holder system 14 is in the process position. In the process position, the substrate holder assembly 2450 supports the substrate 221 in a position where the plating surface generally is immersed face-down in the electrolyte solution contained in the electrolyte cell.

Following processing, the thrust plate 66 including the substrate extension unit 390 and the main thrust plate portion 266 are both raised to the exchange position shown in FIG. 4. The raising of the thrust plate 66 is accomplished by the first vacuum source 2773*a* establishing a vacuum. Following the raising of the entire thrust plate 66, the third vacuum source 2773*c* applies a slight pressure to vertically displace the substrate extension portion 390 relative to the main thrust plate portion 266. This relative vertical displacement disengages metal deposits that may have formed between the O-ring 385 and the backside of the substrate 221 during processing. The disengaging of the metal deposits thereby dislodges the substrate 221 from the main thrust plate portion 266. After the substrate is disengaged from the main thrust plate portion, the substrate is still attached to the substrate extension unit 390 by the vacuum supplied by the second vacuum source 2773*b*.

After the substrate is dislodged from the thrust plate 66 and the O-ring 385, the substrate extension unit 390 continues downward travel relative to the main thrust plate portion 266 into the spin-dry position shown in FIG. 6 by deactuation of the third vacuum source 2773*c*. At this time, the rotatable head assembly 2410 can rotate the substrate extension unit 390, and the main thrust plate portion 266 that is connected thereto by key 403, about a vertical access with the substrate 221 attached thereto. The main thrust plate portion 266, the substrate extension unit 390, the spring assembly 2732, the electric contact element 67, and the substrate can all be spun as a unit using the head rotation motor 2706 of the rotatable head assembly shown in FIG. 3B.

While the substrate extension portion 390 is vertically spaced from the main thrust plate portion 266 by the deactuation of the third vacuum source 2773*c* into the position shown in FIG. 6, the substrate 221 is spaced from both the main thrust plate portion 266 and the electric contact element 67. Such displacements between the substrate 221, the main thrust plate portion 266, and the electric contact element 67 limits the formation of fluid traps that may otherwise be formed by the surfaces of any two of these three members. Additionally, the main thrust plate portion 266 is spaced from both the electric contact element 67 and the substrate extension portion 390. With the substrate 221 and the components of the thrust plate 66 in this position, it is desired to spin the substrate 221 at sufficient velocities reaching up to about 3000 RPM to force liquids from the surface of the substrate under the influence of the centrifugal force.

This spacing between the main thrust plate portion 266, the substrate 221, the substrate extension unit 390, and the electric contact element limits the formation of fluid traps between two or more of these elements. Positioning the substrate holder assembly 2450 as shown in FIG. 6 limits the formation of the fluid traps by vertically spacing the substrate from both the electric contact element and the main thrust plate portion. This limitation of fluid traps allows liquids, such as electrolyte solution that exist on the surfaces of the substrate 221, and the surfaces of the main thrust plate portion 266, the substrate extension unit 390, and the electric contact elements 67 to be effectively removed, typically substantially laterally, from the substrate surfaces under the centrifugal force of inertia caused by the spinning. The residual electrolyte solution that would typically be contained in the fluid traps are removed, due to the lack of the fluid traps. The substrate extension unit 390, the main thrust plate portion 266, the contact element 2299, and the substrate 221 all rotate as a unit due to the key 403.

The angular velocity of the rotation motor 2706 is controlled by controller 222. The controller varies the angular velocity depending upon whether the substrate 221 is being inserted into the electrolyte solution contained in the electrolyte cell, the substrate is being processed, the substrate is being spun dried, or the substrate is being inserted into, or removed from, the substrate holder assembly 2450.

The second vacuum generator 2790*b* shown in FIG. 3B controllably applies a vacuum to the annulus defined by the lip seal 398, the lower surface of the plate of the substrate extension unit 390, and the backside of the substrate 221. The vacuum created by the vacuum generator 2790 is sufficient to retain the substrate 221 by the substrate extension unit 390. FIG. 5, for example, shows the lip seal 398 in a deformed position that it might assume when sufficient vacuum is applied to hold the substrate 221 to the substrate extension unit 390. The lip seal 398 and the O-ring 385 is also deformed and provides a sealing action against electrolyte solution that may flow to the backside, when the first vacuum source 2773*a* is deactuated, the third vacuum source 2773*c* is actuated and the thrust plate biases the substrate against the electric contact element.

Securing and processing of the substrate has been described relative to the substrate holder assembly 2450. The progression of the substrate holder system 14 to perform this processing is shown in FIG. 7, during a portion of the processing in which a metal film is deposited on a seed layer formed on the substrate. The operation of the substrate holder system shown in FIGS. 7A to 7F is to be read in conjunction with FIG. 11, that shows a flow chart of one embodiment of method 1100 to control the operation of the substrate holder system 14.

Figure 7B:
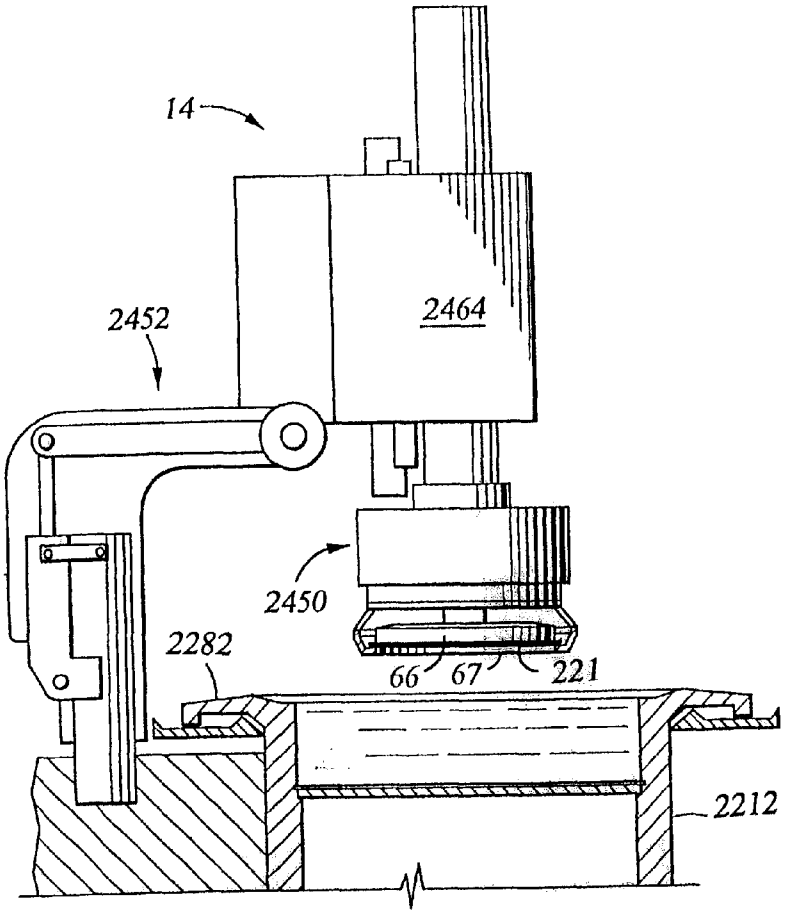
FIGS. 7A to 7F, is a progression illustrating side views of the substrate holder system of FIG. 3B during insertion of a substrate into, and removal of the substrate from, electrolyte solution contained in an electrolyte cell.
Figure 7A:
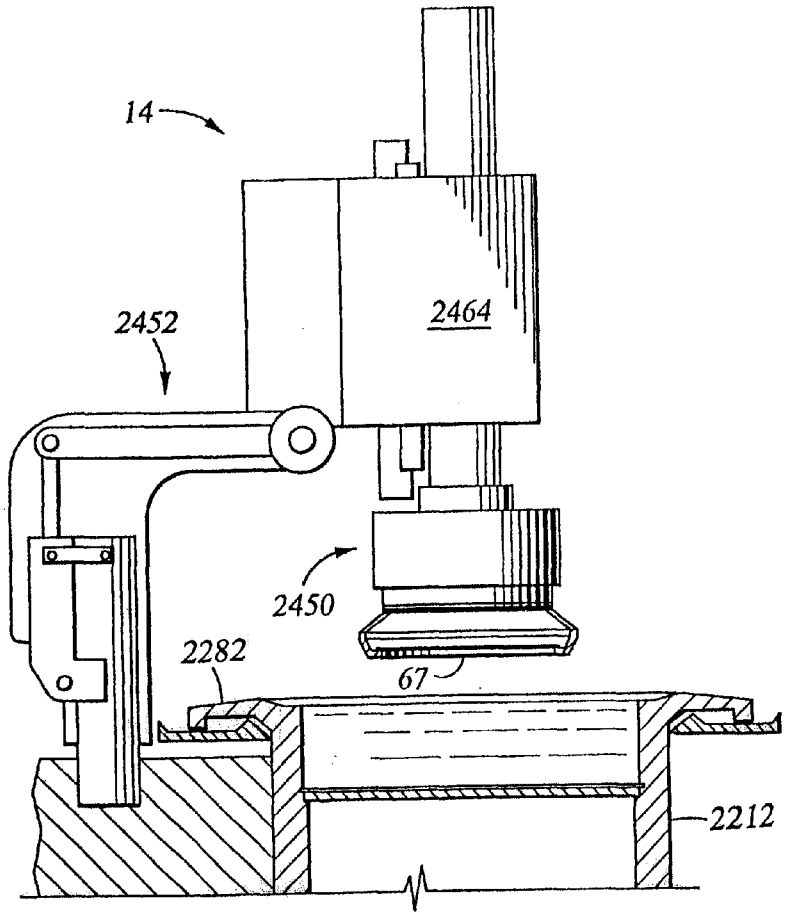
Figure 11:
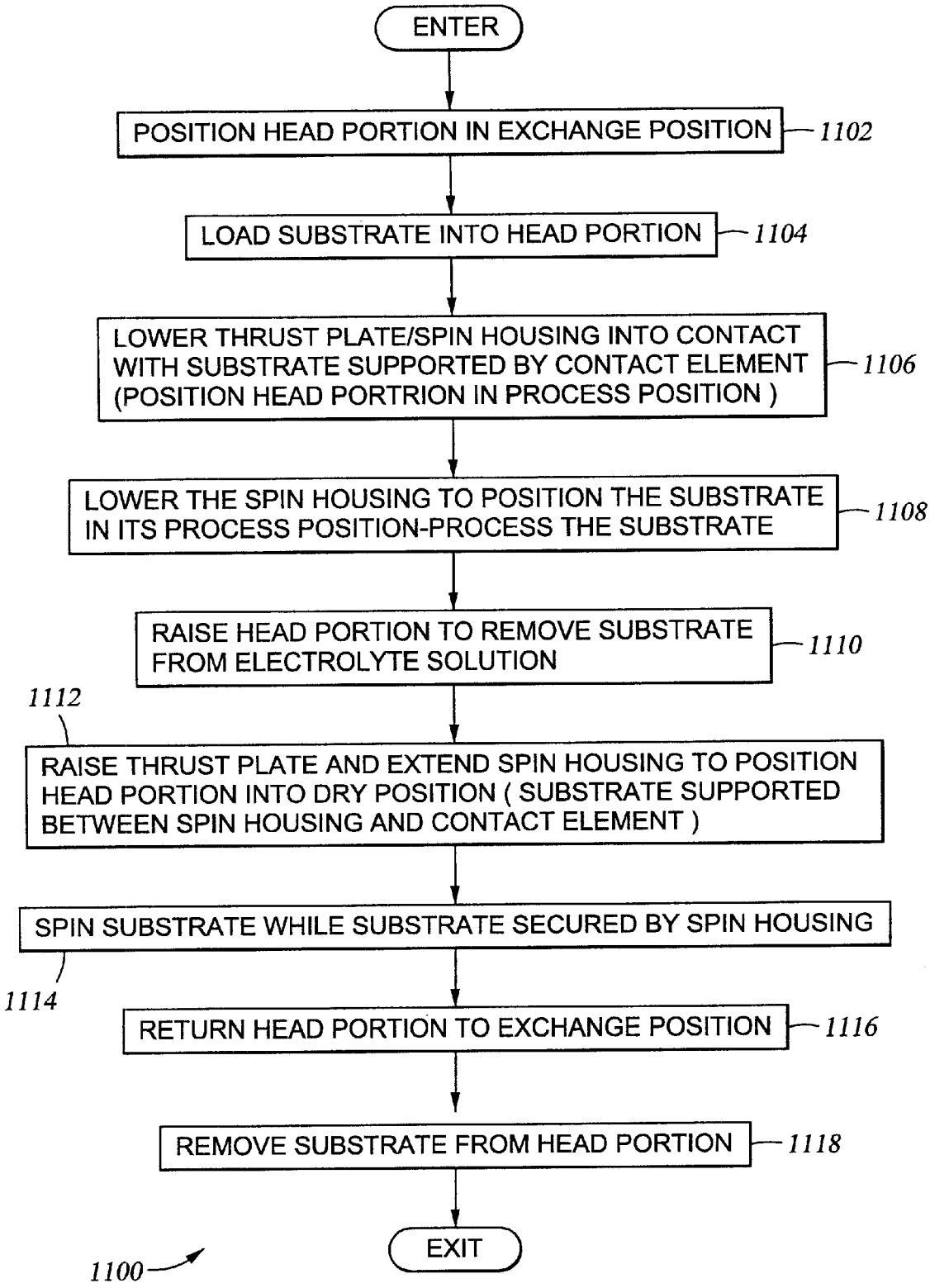
FIG. 11 is a flow chart of an embodiment of the method performed by the controller of FIG. 2 during the progression shown in FIGS. 7A to 7F.

In FIG. 7A, and block 1102 of FIG. 11, the substrate holder assembly 2450 is positioned in an exchange position in which the thrust plate 66 is raised and the substrate extension portion is retracted within the main thrust plate portion 266. While the substrate holder assembly 2450 is in the exchange position, a robot blade containing a substrate can be inserted between the thrust plate and the contact element. The robot inserts the substrate 221, normally with the substrate in an inverted position, into the substrate holder assembly in a manner that the substrate 221 is supported by the electric contact element 67 as indicated in block 1104 of FIG. 11.

Figure 7D:
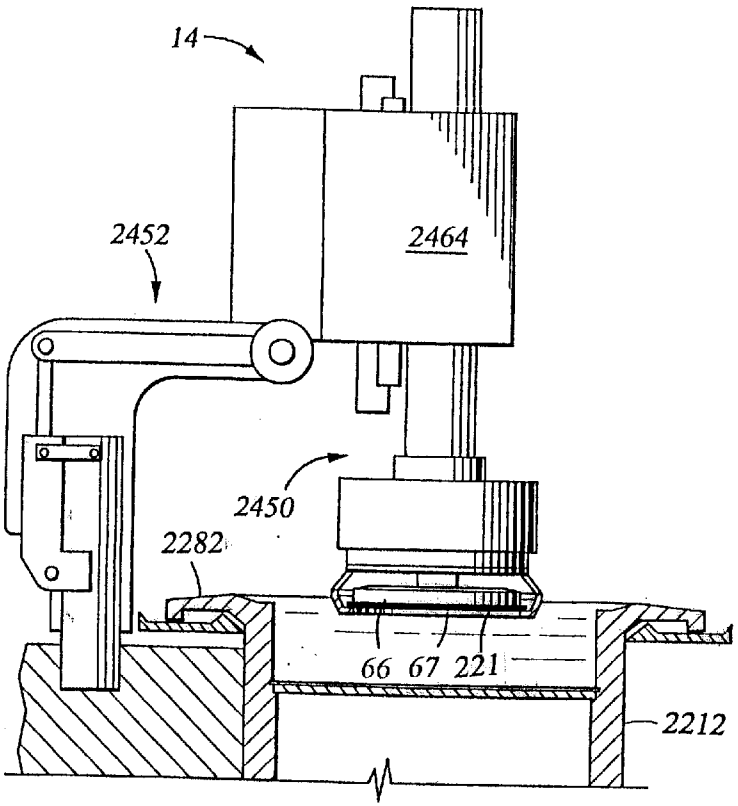

In FIG. 7B, the thrust plate 66 including the combined main thrust plate portion 66 and substrate extension unit 390, shown in FIG. 3B, is lowered to exert a physical force against the backside of the substrate (the backside of the substrate faces up since the substrate is inverted) to secure the substrate 221 against the electric contact elements 67. The force establishes and maintains an electric contact between the substrate seed layer and the electric contact element 67 as shown in block 1106. The thrust plate 66 is not lowered with sufficient force, however, to damage the substrate 221. The lowering of the thrust plate is accomplished by decreasing the vacuum within the pressure reservoir 2740 by the deactuation of the first vacuum source 2773*a*, shown in FIGS. 3–6, to allow the spring bellow connector 2729 to force the thrust plate 66 downward. The thrust plate remains in the lowered biased position until the thrust plate is moved to the exchange position as indicated by FIG. 7F.

Figure 7C:
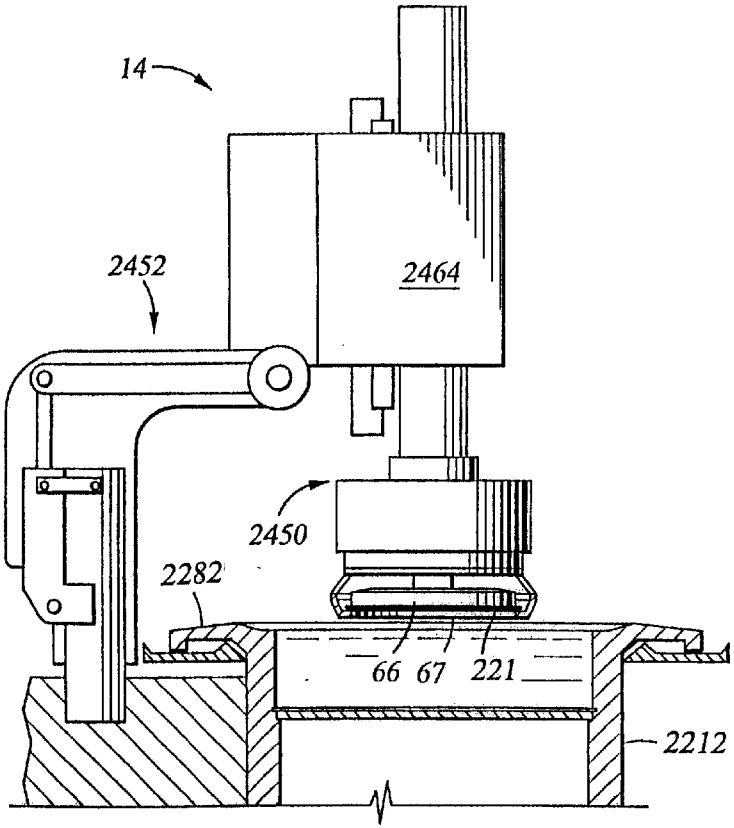
Figure 7F:
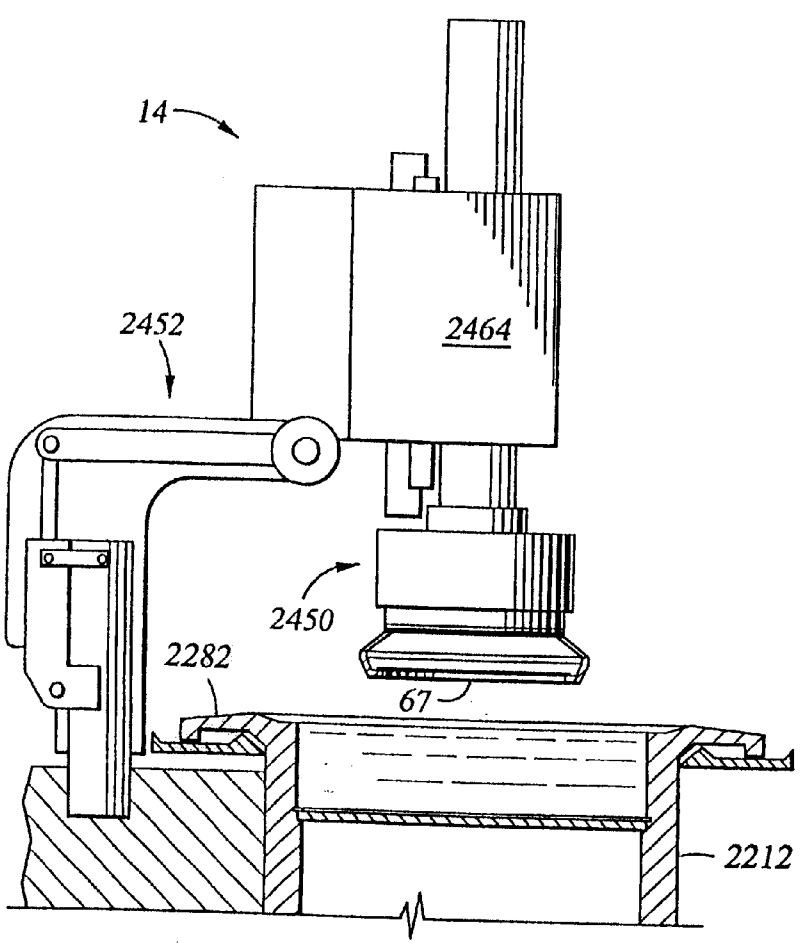

FIG. 7C shows the lowering of the substrate holder assembly 2450 to effect insertion of the substrate 221, contained in the substrate holder assembly 2450, into the electrolyte solution. To effect this lowering of the substrate holder assembly 2450, the lift guide 2466 is moved downwardly along the mounting slide 2460 (see FIG. 3A) to displace the shaft 2468 downward. In one embodiment, the substrate holder assembly 2450 can be tilted from horizontal by, e.g., pivoting the head assembly 2410 in FIG. 3A about pivot joint 2459 in a direction as indicated by arrow A3, during immersion of the substrate into the electrolyte solution. This tilting enhances the removal of air that may be trapped within the electrolyte solution under the substrate and/or substrate holder assembly during the immersion. FIG. 7D shows the substrate holder assembly 2450 positioned in its process position as indicated by block 1108. To displace the substrate holder assembly to the process position, the substrate 221 is either rotated to a substantially horizontal process position within the electrolyte solution by actuation of the cantilever arm actuator 2457 shown in FIG. 3A and/or the lift guide 2466 is displaced along the mounting slide to vertically lower the substrate holder assembly.

While the substrate holder assembly is in its process position, the substrate may be either spun by the head rotation motor 2706 or the substrate may not be rotated. The metal film deposition performed during the ECP process is primarily accomplished when the substrate holder assembly is in its process position.

Figure 7E:
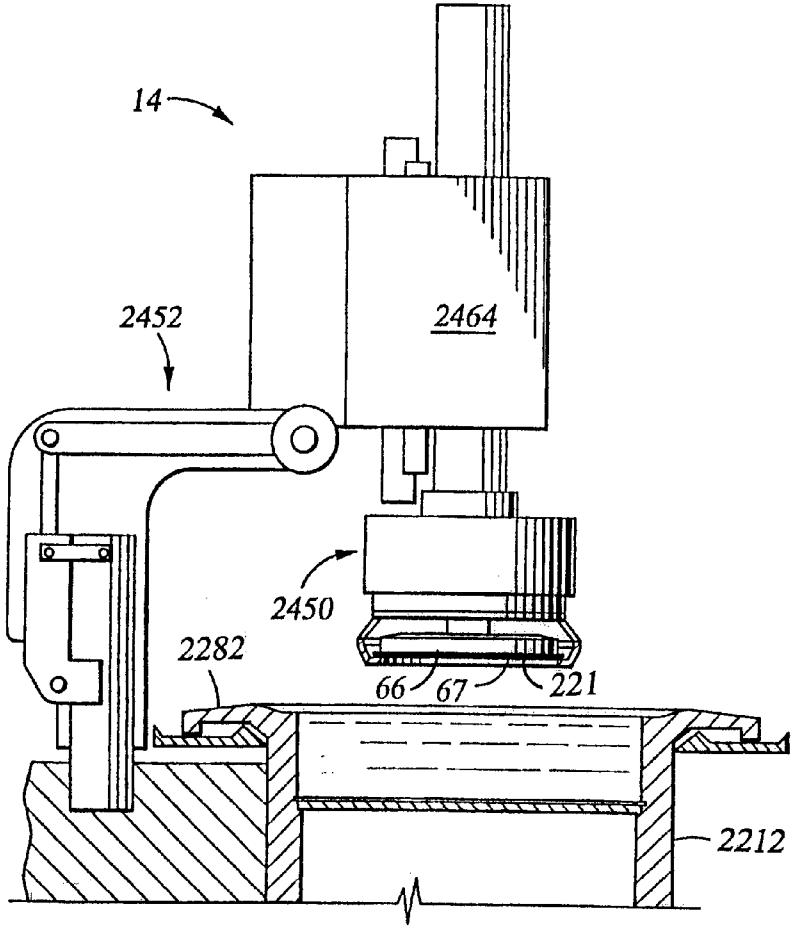

FIG. 7E and block 1110 in FIG. 11 in method 1100 shows the substrate holder assembly 2450 being raised to remove the substrate from the electrolyte solution in the electrolyte cell. As the substrate is removed from the electrolyte solution, the metal film deposition on the seed layer ceases and no further processing occurs on the substrate. The raising of the substrate holder assembly 2450 is accomplished by the head lift actuator 2458 vertically displacing the lift guide 2466 along the mounting slide 2460.

In FIG. 7F, which corresponds to block 1112 in FIG. 11, the substrate holder assembly 2450 is moved into the dry position, shown in FIG. 6, in which the thrust plate 66 is raised and the substrate extension unit 390 is extended downwardly from within the spin recess 389 formed in the main thrust plate portion 266 by deactuation of the second vacuum source 2773*b*. The substrate extension unit 390 holds the substrate 221 above the level of electric contact element 67. As shown in block 1114 of method 1100, while the substrate holder assembly 2450 is in the dry portion, rotation about the vertical axis is imparted to the substrate from the head rotation motor 306. The substrate 221, the substrate extension unit 390, the main thrust plate portion 266, and the plunger rod 330 all rotate as a unit. The substrate is preferably spun while the substrate holder assembly 2450 is in the dry position for a sufficient duration to dry the substrate under the influence of inertia.

The extension of the substrate extension unit 390 that spaces the substrate from the main thrust plate portion limits the formation of fluid traps between the surfaces of any two of the substrate extension unit 390, the substrate, the electric contact element 67, and the main thrust plate portion 266. The limitations of such fluid traps improves the removal of the electrolyte solution from contacting the substrate, the electric contact element 67, or the main thrust plate portion 266, or the substrate extension unit 390 following the spinning. The electrolyte solution is removed from these surface more completely by the inertia caused by the rotation of the substrate holder assembly 2450.

In block 1116 of method 1100, the substrate holder assembly 2450 is displaced to the exchange position as shown in FIGS. 4 and 7A by actuation of the third vacuum source 2773*c*. When the substrate holder assembly 2450 is in its exchange position, the substrate extension unit 390 is retracted within the main thrust plate portion 266 for a sufficient distance to provide for removal of the substrate 221, using a robot blade, from the substrate holder assembly 2450. In block 1118 of method 1100, a robot blade is inserted between the substrate 221 and the thrust plate, and attached, usually by vacuum chucking, to the backside of the substrate 221. The substrate 221 is then removed from the substrate holder assembly 2450. After the substrate 221 is removed from the substrate holder assembly 2450, another substrate 221 may be inserted in the substrate holder assembly 2450 to repeat the above metal deposition process depicted in FIGS. 7A to 7F, and the method 1100 shown in FIG. 11.

There are multiple embodiments disclosed herein that enhance the removal of the electrolyte solution from the surface of the substrate after the substrate is removed from the electrolyte solution. Such enhanced removal of the electrolyte solution decreases further crystal formations on the surface of the substrate. Such decrease of further depositions and crystal formations on the surface of the substrate limits contamination of process cells, robots, and processing devices that subsequently encounter the substrate and/or the substrate holder assembly.

3. Sealing Structure and Operation

Figure 8:
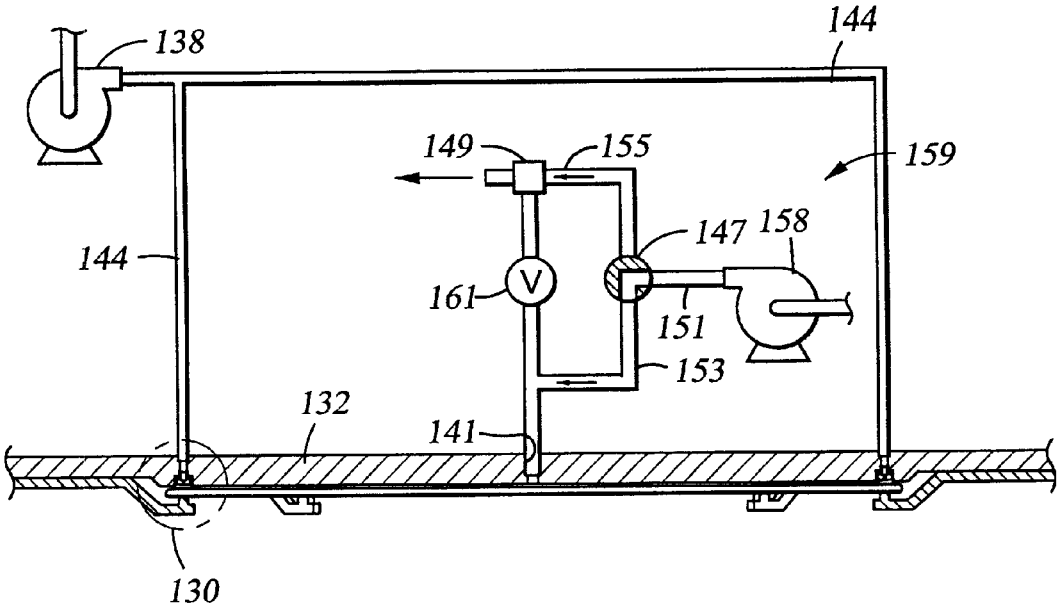
FIG. 8 is a side cross sectional view of a portion of one embodiment of the substrate extension unit including associated pumps and piping associated with the substrate extension unit.
Figure 9:
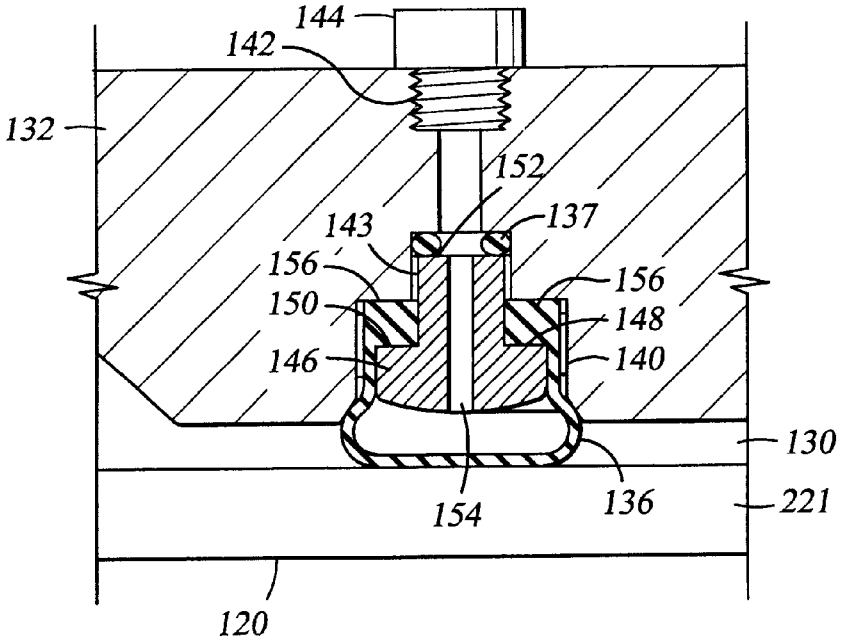
FIG. 9 is an expanded side cross sectional view of one embodiment of the bladder arrangement of the substrate extension unit of FIG. 8.
Figure 10:
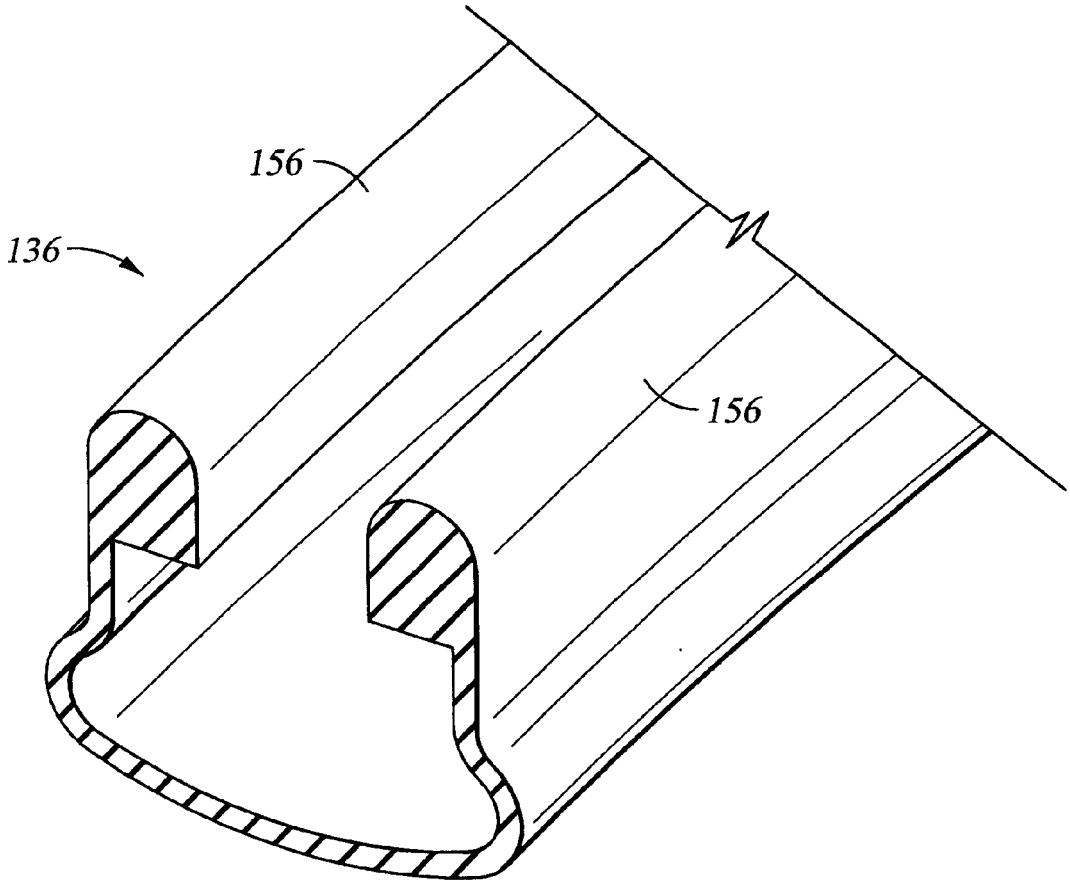
FIG. 10 is a perspective view of the bladder included in the bladder arrangement of FIG. 9.

An embodiment of bladder assembly 130 shown in FIGS. 8–10 is now described that can be used to secure substrates to the substrate extension unit 390. The bladder assembly is secured to a mounting plate 132 of the substrate extension unit 390, and is an alternative embodiment to the lip seal 398 shown in FIGS. 4 to 6. The bladder assembly 130 is configured to maintain a vacuum between the substrate extension unit and the backside of a substrate, even if the substrate has uneven metal depositions thereupon. The bladder assembly also maintains substantially uniform pressure radially around the substrate in the horizontal plane. This uniform pressure results in uniform contact between the substrate and the contact element radially around the substrate in the horizontal plane.

Referring now to FIGS. 8 and 9, the details of the bladder assembly 130 will be discussed. The mounting plate 132 is shown as substantially disc-shaped having an annular recess 140 formed on a lower surface and a centrally disposed vacuum port 141. One or more inlets 142 are formed in the mounting plate 132 and lead into the relatively enlarged annular mounting channel 143 and the annular recess 140. Quick-disconnect hoses 144 couple the fluid source 138 to the inlets 142 to provide a fluid thereto. The vacuum port 141 is preferably attached to either a vacuum/pressure pumping system 159 or the vacuum generator 2790 that are adapted to selectively supply a pressure or create a vacuum at a backside of the substrate 221.

The vacuum/pressure pumping system 159 comprises a pump 158, a cross-over valve 147, and a vacuum ejector 149, commonly known as a venturi. One vacuum ejector that may be used to advantage in the present invention is available from SMC Pneumatics, Inc., of Indianapolis, Ind. The pump 158 may be a commercially available compressed gas source and is coupled to one end of a hose 151, the other end of the hose 151 is coupled to the vacuum port 141. The hose 151 is split into a pressure line 153 and a vacuum line 155 having the vacuum ejector 149 disposed therein. Fluid flow is controlled by the cross-over valve 147 which selectively switches communication with the pump 158 between the pressure line 153 and the vacuum line 155. Preferably, the cross-over valve has an off setting whereby fluid is restricted from flowing in either direction through hose 151. A shut-off valve 161 disposed in hose 151 prevents fluid from flowing from pressure line 155 upstream through the vacuum ejector 149. The desired direction of fluid flow is indicated by arrows. The cross-over valve 147 is controlled by the controller 222.

Other similar arrangements do not depart from the spirit and scope of the present invention. For example, the fluid source 138 can be a gas supply coupled to hose 151, thereby eliminating the need for a separate pump 138. Further, a separate gas supply and vacuum pump may supply the backside pressure and vacuum conditions. While it is preferable to allow for both a backside pressure as well as a backside vacuum, a simplified embodiment may comprise a pump capable of supplying only a backside vacuum. However, as will be explained below, deposition uniformity may be improved where a backside pressure is provided during processing. Therefore, an arrangement such as the one described above including a vacuum ejector and a cross-over valve is preferred.

Referring now to FIG. 9, a substantially circular ring-shaped manifold 146 is disposed in the annular recess 140. A plurality of fluid outlets 154 are formed in the manifold 146 to provide communication between the inlets 142 and the bladder 136. Seals 137, such as O-rings, are disposed in the annular manifold channel 143 in alignment with the inlet 142 and fluid outlet 154 and secured by the mounting plate 132 to ensure an airtight seal. Conventional fasteners, not shown, such as screws may be used to secure the manifold 146 to the mounting plate 132 via cooperating threaded bores, not shown, formed in the manifold 146 and the mounting plate 132.

Referring now to FIG. 10, the bladder 136 is shown, in section, as an elongated substantially semi-tubular piece of material having annular lip seals 156, or nodules, at each edge. A portion of the bladder 136 is compressed against the walls of the annular recess 140 by the manifold 146 which has a width slightly less, e.g., a few millimeters, than the annular recess 140. Thus, the manifold 146, the bladder 136, and the annular recess 140 cooperate to form a fluid-tight seal. To prevent fluid loss, the bladder 136 is preferably comprised of some fluid impervious material such as silicon rubber or any comparable elastomer that is chemically inert with respect to the electrolyte solution and exhibits reliable elasticity. A covering, not shown, may be disposed over bladder 136, and the covering preferably comprises an elastomer such as VITON® (a registered trademark of the E.I duPont de Nemoirs and Company of Wilmington, Del.), buna rubber or the like, which may be reinforced by KEVLAR® (a registered trademark of the E.I duPont de Nemoirs and Company of Wilmington, Del.), for example. In one embodiment, the covering and the bladder 136 comprise the same material. The covering has particular application where the bladder 136 is liable to rupturing. Alternatively, the bladder 136 thickness may simply be increased during its manufacturing to reduce the likelihood of puncture. The precise number of inlets 142 and fluid outlets 154 may be varied according to the particular application without deviating from the present invention.

In operation, substrate 221 is introduced into the container body 102 by securing it to the lower side of the mounting plate 132. This is accomplished by engaging the pumping system 159 to evacuate the space between the substrate 221 and the mounting plate 132 via port 141, thereby creating a vacuum condition. The bladder 136 is then inflated by supplying a fluid such as air or water from the fluid source 138 to the inlets 142. The fluid is delivered into the bladder 136 via the manifold outlets 154, thereby pressing the substrate 221 uniformly against the contacts 226 within the electric control element.

Because of its flexibility, the bladder 136 deforms to accommodate the asperities of the substrate backside and electric contacts 226 thereby mitigating misalignment with the conducting contacts 226. The compliant bladder 136 prevents the electrolyte solution from contaminating the backside of the substrate 221 by establishing a fluid tight seal at a perimeter portion of the backside of the substrate 221. Once inflated, a uniform pressure is delivered downward toward the contacts 226 to achieve substantially equal force at all points where the substrate 221 and contacts 226 interface. The force can be varied as a function of the pressure supplied by the fluid source 138. Further, the effectiveness of the bladder assembly 130 is not dependent on the configuration of the contacts 226. For example, the contacts on electric contact element 67 may include a plurality of discrete contact points, or alternatively the contact element may be configured as a continuous surface.

Because the force delivered to the substrate 221 by the bladder 136 is variable, adjustments can be made to the current flow supplied by the electric contact element 67. An oxide layer may form on the contacts 226 and act to restrict current flow. However, increasing the pressure of the bladder 136 may counteract the current flow restriction due to oxidation. As the pressure is increased, the malleable oxide layer is compromised and superior contact between the contacts 226 and the substrate 221 results. The effectiveness of the bladder 136 in this capacity may be further improved by altering the geometry of the contacts 226. For example, a knife-edge geometry is likely to penetrate the oxide layer more easily than a dull rounded edge or flat edge.

Additionally, the fluid tight seal provided by the inflated bladder 136 allows the pump 158 to maintain a backside vacuum or pressure either selectively or continuously, before, during, and after processing. Generally, however, the pump 158 is run to maintain a vacuum only during the transfer of substrates to and from the electroplating electrolyte cell 2212 because it has been found that the bladder 136 is capable of maintaining the backside vacuum condition during processing without continuous pumping. Thus, while inflating the bladder 136, as described above, the backside vacuum condition can be simultaneously relieved by disengaging the pumping system 159, e.g., by selecting an off position on the cross-over valve 147. Disengaging the pumping system 159 may be either an abrupt or gradual process whereby the vacuum condition is ramped down. Ramping allows for a controlled exchange between the inflating bladder 136 and the simultaneously decreasing backside vacuum condition. This exchange may be controlled manually or by the controller 222.

Continuous backside vacuum pumping by the pump 158, while the bladder 136 is inflated, is not required and may actually cause the substrate 221 to buckle or warp leading to undesirable deposition results. For a 200 mm wafer a backside pressure of about 5 psi may bow the substrate. Because substrates typically exhibit some measure of pliability, a backside pressure causes the substrate to bow or assume a convex shape relative to the upward flow of the electrolyte solution. The degree of bowing is variable according to the pressure supplied by pumping system 159.

There may be cases, however, where it is desirable to provide a backside pressure to the substrate 221 in order to cause a "bowing" effect of the substrate to be processed. Bowing may result in a more desired thickness of metal film deposition across the surface of the substrate, for example, the thickness of a deposited metal film might be more uniform. Thus, pumping system 159 is capable of selectively providing a vacuum or pressure condition to the substrate backside.

Those skilled in the art will readily recognize other embodiments that are contemplated by the present invention. For example, while FIG. 9 shows a preferred bladder 136 having a surface area sufficient to cover a relatively small perimeter portion of the substrate backside at a diameter substantially equal to the contacts 226, the bladder assembly 130 may be geometrically varied. Thus, the bladder assembly may be constructed using a more fluid impervious material or cover an increased surface area of the substrate 221.

As noted above, the electrolyte cell 2212 is a typical ECP system cell wherein a substrate is secured at an upper end. However, other cell designs known in the art employ a mounting plate, or substrate holder plate, disposed at a lower end of a cell such that the electrolyte solution flows from top to bottom. The present invention contemplates such a construction as well as any other construction requiring the advantages of a fluid-tight backside seal to provide a vacuum and/or prevent backside deposition and contamination. Thus, the precise location of the bladder assembly 130 is arbitrary.

The present invention has particular application where contacts 226 of varying geometries are used. It is well known that a constriction resistance, $R_{CR}$, results at the interface of two conductive surfaces, such as between the contacts 226 and the substrate seed layer 15, due to asperities between the two surfaces. Generally, as the applied force is increased the apparent contact area is also increased. The apparent area is in turn inversely related to $R_{CR}$ so that an increase in the apparent area results in a decreased $R_{CR}$, Thus, to minimize overall resistance it is preferable to maximize force. The maximum force applied in operation is limited by the yield strength of a substrate that may be damaged under excessive force and resulting pressure. However, because pressure is related to both force and area, the maximum sustainable force is also dependent on the geometry of the contacts 226. Thus, while the contacts 226 may have a flat upper surface as in FIG. 2, other shapes may be used to advantage. The pressure supplied by the inflatable bladder 136 may then be adjusted for a particular contact geometry to minimize the constriction resistance without damaging the substrate. A more complete discussion of the relation between contact geometry, force, and resistance is given in Ney Contact Manual, by Kenneth E. Pitney, The J. M. Ney Company, 1973, which is hereby incorporated by reference in its entirety.

While foregoing is directed to preferred embodiments of the present invention, other and further embodiments of the invention may be devised without departing from the basic scope thereof, and the scope thereof is determined by the claims that follow.

What is claimed is:

1. A thrust plate for retaining a substrate comprising:

a main thrust plate portion at least partially defining a spin recess; and a substrate extension unit displaceable between a retracted position and an extended position, wherein the substrate extension unit when in its retracted position is disposed substantially within the spin recess, and wherein the substrate extension unit, when in its extended position, at least partially extends from within the spin recess.

2. The thrust plate of claim 1, further comprising a substrate holder assembly, wherein when the substrate extension unit is in its extended position, the substrate extension unit can hold a substrate at a position remote from the main thrust plate portion.

3. The thrust plate of claim 1, wherein the substrate extension unit is constrained to rotate at the same angular velocity as the main thrust plate portion.

4. The thrust plate of claim 3, further comprising a key coupled to the substrate extension unit and coupled to the main thrust plate portion, the key is configured to permit substantial vertical displacement, while limiting relative rotation in a substantial horizontal plane, between the substrate extension unit and the main thrust plate portion.

5. The thrust plate of claim 3, wherein a head rotation motor also rotates said substrate extension unit.

6. The thrust plate of claim 1, further comprising a head rotation motor that can rotate the main thrust plate portion.

7. The thrust plate of claim 1, further comprising a head rotation motor that rotates the main thrust plate portion and the substrate extension unit.

8. The thrust of claim 7, further comprising a vacuum source that extends the substrate extension unit relative to the main thrust plate portion.

9. The thrust plate of claim 7, wherein the substrate extension unit comprises one from the list of lip seal and O-ring that is configured to form a seal with the substrate to support the substrate.

10. The thrust plate of claim 1, further comprising a contact element, wherein the main thrust plate portion can bias a substrate into electric contact with the contact element.

11. The thrust plate of claim 10, wherein the main thrust plate portion comprises an O-ring that contacts the backside of the substrate to bias the substrate into electric contact with the contact element.

12. The thrust plate of claim 10, wherein the main thrust plate portion comprises an O-ring, wherein the substrate has a first side disposed on the contact element and a second side is opposite the first side, and the O-ring can be displaced to bias the second side so the first side is biased against the contact element.

13. The thrust plate of claim 1, further comprising a bellow, wherein the substrate has a first side disposed on the contact element and a second side is opposite the first side, the bellow biases the second side so the first side is biased against the contact element.

14. A method for holding a substrate using a main thrust plate portion having a spin recess, the method comprising:

positioning a substrate extension unit into an extended position wherein the substrate extension unit at least partially extends from within the spin recess, wherein the substrate is secured by the substrate extension unit in a position remote from the main thrust plate portion.

15. The method of claim 14, further comprising rotating the substrate extension unit to cause spinning of the substrate.

16. The method of claim 14, further comprising displacing the substrate extension unit into a retracted position wherein the substrate extension unit is contained within the spin recess.

17. An apparatus comprising:

a seal that biases a substrate against an electric contact while permitting a substrate holder assembly to rotate the substrate while the substrate holder assembly is in a first rotational configuration during plating, and the seal secures the substrate to the substrate holder assembly to spin the wafer when the substrate holder assembly is in a second rotational configuration in which the substrate is remote from the electric contact.

18. The apparatus of claim 17, further comprising a main thrust plate portion having a spin recess formed therein; and a substrate extension unit that can be located within the spin recess.

19. The apparatus of claim 18, wherein the substrate extension unit is substantially retracted into the spin recess when the substrate holder assembly is in its first rotational configuration.

20. The apparatus of claim 18, wherein the substrate extension unit is substantially extended from the spin recess when the substrate holder assembly is in its second rotational configuration.

21. The apparatus of claim 18, wherein the seal is an inflatable seal.

22. The apparatus of claim 18, wherein the seal comprises an O-ring.

23. The apparatus of claim 18, wherein the seal comprises a lip seal.

24. The apparatus of claim 17, wherein the seal comprises a plurality of seals, wherein at least one of the seals is remote from the substrate when the substrate is remote from the electric contact.

25. A method for removal of electrolyte solution from a substrate and a substrate holder assembly comprising:

providing a main thrust plate portion at least partially defining a spin recess; and providing a substrate extension unit that can be displaced between a retracted position and an extended position, wherein the substrate extension unit is disposed within the spin recess when positioned in the retracted position, the substrate extension unit at least partially extends from within the spin recess when positioned in the extended position;

processing the substrate by immersing at least a portion of the substrate in a wet solution;

removing the substrate from the wet solution;

extending the substrate extension unit into its extended position, and securing the substrate to the substrate extension unit; and spinning the substrate.

26. The method of claim 25, wherein the extending the substrate extension unit into its extended position limits the formation of fluid traps within the substrate holder assembly or between the substrate and the substrate holder assembly.

27. The method of claim 25, wherein the substrate extension unit comprises one from the list of lip seal and O-ring that is configured to form a seal with the substrate to support the substrate.

28. The method of claim 25, further comprising a contact element, wherein the main thrust plate portion can bias a substrate into electric contact with the contact element.

* * * * *